US011077994B2

(12) United States Patent
Meyer et al.

(10) Patent No.: US 11,077,994 B2
(45) Date of Patent: Aug. 3, 2021

(54) METHOD AND APPARATUS FOR CONTROLLED TRANSFER OF FLUID

(71) Applicant: Vection Limited, Boulder, CO (US)

(72) Inventors: Mathew Meyer, Erie, CO (US); Yuta Okkotsu, Aurora, CO (US)

(73) Assignee: VECTION LIMITED, Erie, CO (US)

( * ) Notice: Subject to any disclaimer, the term of this patent is extended or adjusted under 35 U.S.C. 154(b) by 0 days.

(21) Appl. No.: 16/671,129

(22) Filed: Oct. 31, 2019

(65) Prior Publication Data

US 2020/0062466 A1 Feb. 27, 2020

Related U.S. Application Data

(63) Continuation-in-part of application No. 15/967,328, filed on Apr. 30, 2018, now Pat. No. 10,494,153, (Continued)

(51) Int. Cl.
*B65D 47/24* (2006.01)
*B65D 47/04* (2006.01)

(52) U.S. Cl.
CPC ..... *B65D 47/242* (2013.01); *B65D 47/043* (2013.01); *B65D 2501/0081* (2013.01)

(58) Field of Classification Search
CPC ..... B65D 47/242; B65D 47/043; B65D 2501/0081; B65D 1/023; B65D 1/0246; B65D 47/2031; B65D 47/12; B65D 47/125; B65D 51/16; B65D 2205/00; B65D 41/0442; B65D 41/0435; B65D 41/04;

(Continued)

(56) References Cited

U.S. PATENT DOCUMENTS 1,413,703 A * 4/1922 Favil ..... B65D 51/002 215/247
2,526,622 A * 10/1950 Martin ..... B65D 39/04 215/355

(Continued)

FOREIGN PATENT DOCUMENTS

WO 02100764 A2 12/2002
WO 2007112569 A1 10/2007

OTHER PUBLICATIONS

"Basics of Injection Molding Design", http://www.3dsystems.com/quickparts/learning-center/injection-molding-basics website article, 2015, 3D Systems, Inc.

(Continued)

*Primary Examiner* — Kareen K Thomas
(74) *Attorney, Agent, or Firm* — Voz Patents, LLC

(57) ABSTRACT

Embodiments of the present disclosure generally relate to caps, closures, seals, and containers, and control of flow of fluids. Certain embodiments can be used with fluids related to machinery, for instance, engine oil, brake fluid, coolant, transmission fluid, and power steering fluid. Certain embodiments of the present disclosure effectively hold and transfer a fluid or a fluid substance, further being able to open, close, and regulate fluid flow. Embodiments include a single piece tubular component that includes a cap interiorly attached to such tubular component with ribs, and a container having a tapered end. In certain embodiments, a tube is attached to the cap. In certain embodiments, a nozzle collar having a tapered end is adapted to attach to a container.

20 Claims, 19 Drawing Sheets

Related U.S. Application Data which is a continuation of application No. 15/045,075, filed on Feb. 16, 2016, now Pat. No. 9,981,786.

(58) Field of Classification Search
CPC . B65D 41/06; B65D 5/74; B65D 1/02; B65D 47/32
See application file for complete search history.

(56) References Cited

U.S. PATENT DOCUMENTS

| | | | | |
|---|---|---|---|---|
| 2,689,665 | A | 9/1954 | Martin | |
| 2,921,708 | A * | 1/1960 | Henri | B65D 39/0029 215/230 |
| 3,278,096 | A | 10/1966 | Miller | |
| 3,305,892 | A | 2/1967 | Heider | |
| 3,893,644 | A | 7/1975 | Drazick | |
| 3,930,413 | A | 1/1976 | Laird et al. | |
| 3,980,211 | A * | 9/1976 | Owens | B65D 47/043 222/478 |
| 3,982,649 | A * | 9/1976 | Wanderer | B65D 39/088 217/108 |
| 4,065,037 | A | 12/1977 | Haller | |
| 4,274,823 | A | 6/1981 | Stanciu et al. | |
| 4,412,806 | A | 11/1983 | Gaiser et al. | |
| 4,456,138 | A | 6/1984 | Bereziat | |
| 4,530,654 | A | 7/1985 | Rose | |
| 4,653,997 | A | 3/1987 | Sheffield et al. | |
| 4,754,899 | A | 7/1988 | Stull | |
| 4,917,594 | A | 4/1990 | Gellert et al. | |
| 4,995,521 | A * | 2/1991 | von Schuckmann | B65D 51/002 215/249 |
| 5,038,958 | A | 8/1991 | Dreier | |
| 5,101,870 | A | 4/1992 | Farris | |
| 5,111,977 | A | 5/1992 | Maguire et al. | |
| 5,297,599 | A | 3/1994 | Bucheli | |
| 5,316,707 | A | 5/1994 | Stanciu et al. | |
| 5,492,658 | A | 2/1996 | Ohno et al. | |
| 5,687,865 | A | 11/1997 | Adams et al. | |
| 5,820,803 | A | 10/1998 | Hashimoto | |
| 6,019,918 | A | 2/2000 | Guergov | |
| 6,142,343 | A | 11/2000 | Wade et al. | |
| 6,375,022 | B1 * | 4/2002 | Zurcher | B65D 41/28 215/232 |
| 6,571,971 | B1 | 6/2003 | Weiler | |
| 6,695,829 | B2 | 2/2004 | Hellstrom et al. | |
| 6,758,376 | B1 | 7/2004 | Clodfelter et al. | |
| 6,834,782 | B2 | 12/2004 | Ritter | |
| 6,872,069 | B2 | 3/2005 | Starkey | |
| 6,893,612 | B2 | 5/2005 | Kacian et al. | |
| 7,097,057 | B2 * | 8/2006 | Classens | B01L 3/50825 215/247 |
| RE39,340 | E | 10/2006 | Adams et al. | |
| 7,306,455 | B2 | 12/2007 | Dewar et al. | |
| 7,331,491 | B2 | 2/2008 | King | |
| 8,177,084 | B2 | 5/2012 | Fox et al. | |
| 8,220,650 | B2 | 7/2012 | Smith et al. | |
| 8,387,810 | B2 | 3/2013 | Livingston et al. | |
| 8,387,811 | B2 | 3/2013 | Livingston et al. | |
| 8,557,359 | B2 | 10/2013 | Yang et al. | |
| 9,580,214 | B2 | 2/2017 | Hatton et al. | |
| 2002/0086086 | A1 | 7/2002 | Doyle et al. | |
| 2003/0164462 | A1 | 9/2003 | Kim et al. | |
| 2004/0232167 | A1 | 11/2004 | King | |
| 2005/0046083 | A1 | 3/2005 | Dewar et al. | |
| 2005/0077322 | A1 | 4/2005 | Graybill | |
| 2007/0036878 | A1 | 2/2007 | Goodenough et al. | |
| 2007/0222111 | A1 | 9/2007 | Hussain et al. | |
| 2009/0084752 | A1 | 4/2009 | Coulson | |
| 2011/0290754 | A1 | 12/2011 | Taber et al. | |
| 2011/0290755 | A1 | 12/2011 | Taber et al. | |
| 2012/0248644 | A1 | 10/2012 | Antunes et al. | |

OTHER PUBLICATIONS

"Blow Molding and Rotational Molding", http://www.sinotech.com/blowMolding.html, website article, 2010, Sinotech, Inc.
"Injection Molding Design Guide", https://www.quickparts.com/PDF/LVIM/Injection_Molding_DesignGuide.pdf, electronic publication. Quickparts.
"Manufacturing of Plastic Bottles", http://newengineeringpractice.blogspot.com/2011/08/manufacturing-of-plastic-bottles.html, blog post, Aug. 2011, Blogger.
alibaba.com, "Aluminum Plastic Bottle Cap for Brandy Packaging", http://www.alibaba.com/product-detail/Aluminum-Plastic-Bottle-Cap-for-Brandy_235903808.html, website.
Bloomberg, "Company Overview of Graham Packaging Company, Inc.", http://www.bloomberg.com/research/stocks/private/snapshot.asp?privcapId=100134756, website article, May 3, 2016, Bloomberg L.P.
Bogren, Rick, "Scientist develops ways to recycle used motor oil containers", http://www.lsuagcenter.com/NR/rdonlyres/AEC5C9A5-4841-46FA-8D6C-D5F1F5193916/55689/LouisianaAgriculturewinter2009web.pdf, Journal Article, 2009. 52-1, LSU AGCenter.
bottles.com, "Caps for Plastic Bottles and Glass Bottles", https://www.ebottles.com/bottlecaps-mat-closures-type-2.htm, company product listing website page, 2015.
Capz Enclosure, Inc., http://capz.webstarts.com/, website.
Closure Systems International, http://www.csiclosure.ocm/, company website, 2016.
encyclopedia.com, "Graham Packaging Holdings", http://www.encyclopedia.com/doc/1G2-2690300050.html#C, website article, 2007.
Final Office Action issued in U.S. Appl. No. 15/495,367 dated Oct. 10, 2019.
Franklin Associates, "Impact of Plastics Packaging on Life Cycle Energy Consumption & Greenhouse Gas Emissions in the United States and Canada—Substitution Analysis", http://plastics.americanchemistry.com/Education-Resources/Publications/Impact-of-Plastics-Packaging.pdf, electronic publication, Jan. 2014.
Graham Packaging Company, "One Quart Motor Oil Redesign", https://www.grahampackaging.com/sites/default/files/Graham%20Case%20Studies_One%20Quart%20Motor%20Oil%20Redesign.pdf, electronic publication.
Graham Packaging Company, https://www.grahampackaging.com/about-us/heritage-innovation, website, 2014.
Green Flame Services, "Empty Plastic Oil Container Recycling", http://www.calrecycle.ca.gov/homehazwaste/Events/AnnualConf/2005/April28/Session1/CertCentMgmt/RecycleChal.pdf, electronic publicatin, Apr. 28, 2005, CalRecycle.
Ibisworld, "Plastic Bottle Manufacturing in the US: Market Research Report", http://www.ibisworld.com/industry/default.aspx?indid=519, website article, May 2016.
Jan. 29, 2018 Notice of Allowance issued in U.S. Appl. No. 15/045,075.
Jun. 14, 2017 Office Action issued in U.S. Appl. No. 15/045,075.
Non-Final Office Action dated Apr. 10, 2019 issued in U.S. Appl. No. 15/495,367.
Oct. 27, 2017 Office Action issued in U.S. Appl. No. 15/045,075.
PCT Community Forum Discussions, http://communities.ptc.com/thread/43317.
Search History for PCT Application No. PCT/US17/29174 to Folaron, et al., ISA communication dated Oct. 2, 2017.
Search Report for PCT Application No. PCT/US17/29174 to Folaron, et al., ISA communication dated Oct. 2, 2017.
valuationresources.com, "Royalty Rates and License Fees", http://valuationresources.com/EconomicData/Royalty.htm, website article.
WPO, http://www.worldpackaging.org/i4a/pages/index.cfm?pageid=1#&panel1-3, website homepage. 2015.

* cited by examiner

METHOD AND APPARATUS FOR CONTROLLED TRANSFER OF FLUID

CROSS REFERENCE TO REFERENCE TO RELATED APPLICATIONS

This application is a continuation-in-part of U.S. patent application Ser. No. 15/967,328, entitled "METHOD AND APPARATUS FOR CONTROLLED TRANSFER OF FLUID", filed Apr. 30, 2018—currently pending—which is a continuation-in-part of U.S. patent application Ser. No. 15/045,075, entitled "METHOD AND APPARATUS FOR CONTROLLED TRANSFER OF FLUID", filed Feb. 16, 2016, the entire contents of which are incorporated herein by reference in its entirety for all purposes.

FIELD OF INVENTION

Embodiments of the present disclosure generally relate to caps, closures, seals, and containers, and control of flow of fluids. Certain embodiments can be used with fluids related to machinery, for instance, engine oil, brake fluid, coolant, transmission fluid, and power steering fluid. Certain embodiments of the present disclosure to effectively hold and transfer a fluid or a fluid substance (referred to as a fluid), further being able to open, close, regulate flow of such fluid. Certain embodiments include a single piece tubular component that includes a cap interiorly attached to such tubular component with ribs, and a container having a tapered end. In certain embodiments, a nozzle collar having a tapered end is adapted to attach to a container.

BACKGROUND OF THE INVENTION

Machinery typically requires consistent maintenance for efficient functioning. Machinery relying on an internal combustion engine, from simple machines such as lawn-mowers, to complex machines such as automobiles and airplanes, the flushing and/or replacement of certain fluids is integral to proper maintenance. For automobiles, certain fluids, such as engine oil, brake fluid, coolant, transmission fluid, power steering fluid, and differential fluid, should be checked or replaced at certain time, distance or duty-cycle based intervals.

Machinery fluid reservoirs typically have at least one opening to add or drain fluid. In many cases, the size of the openings follows industry standards. Filling a reservoir can present challenges, as the location of the reservoir may be in a place that is awkward to reach or the reservoir opening too small. Error in pouring, such as spillage, can adversely affect the operation of mechanical components, create environmental hazards, and waste of fluid. Moreover, a fluid container may be bulky or heavy, making it difficult to deliver fluid from the container to the opening without spillage.

Numerous containers have at least one opening to transfer fluid in or out of the container. Containers may also have caps, tops, or lids that temporarily secure the contents of the container. Transferring fluid from a container to a machine can be challenging. Issues of spillage, low flow rate and uncontrolled flow caused by current containers make fluid transfer increase that challenge. Current commercially available containers holding certain fluids, such as motor oil have a twist-off lid. Yet, those containers have certain disadvantages.

For example, fluids, including motor oil, are commonly sold in predetermined volumes, (for example, 1 quart, 3 quart, 5 quarts, 1 gallon, etc.), where larger volumes correspond to containers holding a larger volume. As the total volume increases, the container mass increases, and it becomes increasingly difficult for a person to hold. As a result, it becomes difficult to transfer a fluid from a container to another container, such as a machine reservoir (e.g. opening for engine oil).

Mass-produced machines, such as automobiles of a particular year, make, and model, have components located in substantially similar areas across all. People come in many different shapes, sizes, heights, strength levels, and abilities. One person of a particular height and strength may have an easier time accessing a single component (e.g. opening for engine oil) of one year, make and model automobile, while a second person may have trouble accessing that component. Further, automobiles of different years, makes, and/or models have machine components located in different areas. A person may easily access a component (e.g. accessing an opening for machine oil) in one automobile, and have difficulty accessing a similar component in a different automobile. Therefore, challenges in holding and steadying a container (e.g. a motor oil container) while pouring may arise when transferring the fluid (e.g. motor oil). These challenges arise particularly when such container is too heavy, or the opening for the fluid is not within comfortable reach. These challenges may also lead to an inability to maintain a steady flow of fluid, resulting in spillage. This issue is exacerbated when using a separate funnel.

Difficulty in holding, stabilizing, maintaining, reaching, or otherwise effectively transferring a fluid from one container to a second container can lead to a number of problems. In one example, the spout of one container may not align properly with an opening of a second container, causing leaks of a fluid in the vicinity or a user's hand. In another example, one container must be held at a position uncomfortable to a user to effectively transfer a fluid into an opening of a second container tiring a user, or in a more unfortunate case, preventing a user from transferring such fluid.

A common solution involves the use of a funnel, placed within the opening of a reservoir, to give a user a decreased chance of error when pouring a fluid from a delivery container into such a reservoir. Using a funnel involves secondary purchase and cleaning/storage considerations, further adding to the inconvenience associated with the use of a funnel. Using a funnel can also be messy and less effective, particularly given a large or heavy container. Fluid leaks may occur when a funnel is not properly secured to a machine reservoir opening. Therefore, controlled pouring through a funnel may require more than two hands to stabilize the funnel and the container, making it difficult for single-person use.

Further still, the use of an inappropriately sized funnel may cause further issue when dispensing fluid from a source container. The use of a funnel that is too small creates possibility of error in dispensing including overflow and spillage. The use of a funnel that is too large creates possibility of the funnel tipping as the fluid is dispensed. Such issues potentially lead to spillage or even knocking the funnel out of the intended opening.

SUMMARY OF THE INVENTION

Embodiments of the present disclosure generally relate to caps, closures, seals, containers, and control of flow of fluids. Embodiments relate to improvements in the system, apparatus, and method of use of a fluid container. Certain embodiments can be used with fluids related to machinery, for instance, engine oil, brake fluid, coolant, transmission fluid, and power steering fluid. Certain embodiments of the present effectively hold and transfer a fluid or a fluid substance (referred to as a fluid), further being able to open, close, regulate flow of such fluid. The system, method, and apparatus in certain embodiments reduce messiness, leaking, uncontrolled flow of a fluid, and increase flow rate as compared to other products such as funnels. Certain embodiments of a container holding a liquid may come in many forms.

Certain embodiments of the present disclosure direct pouring of a fluid in an accurate manner. Certain embodiments transfer a fluid rapidly in a controlled manner. Certain embodiments stop the flow, start the flow, and control the flow of a liquid poured from a container. Certain embodiments allow controlled pouring of a liquid while a container is inverted. Certain embodiments allow cheap manufacturing, for instance, by using less material. Certain embodiments allow appending certain features to existing containers. Certain embodiments also enhance the user experience of dispensing fluids, and presents a more useful way of dispensing fluids in any state, such as liquid and solid. Certain embodiments eliminate the need to use a separate funnel to dispense fluids. Eliminating the need for a separate funnel means a user does not need to purchase a separate funnel. Nor is a user at the mercy of having a funnel available. A user no longer has to clean or dispose of a funnel.

DETAILED DESCRIPTION OF CERTAIN EMBODIMENTS

Figure 1:
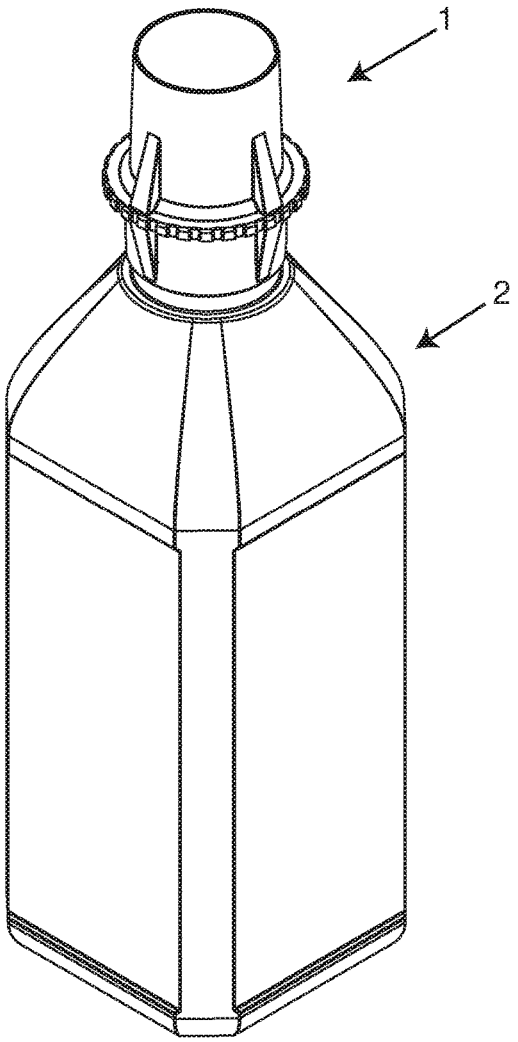
FIG. 1. Perspective view of a container and a closure component in certain embodiments.
Figure 2A:
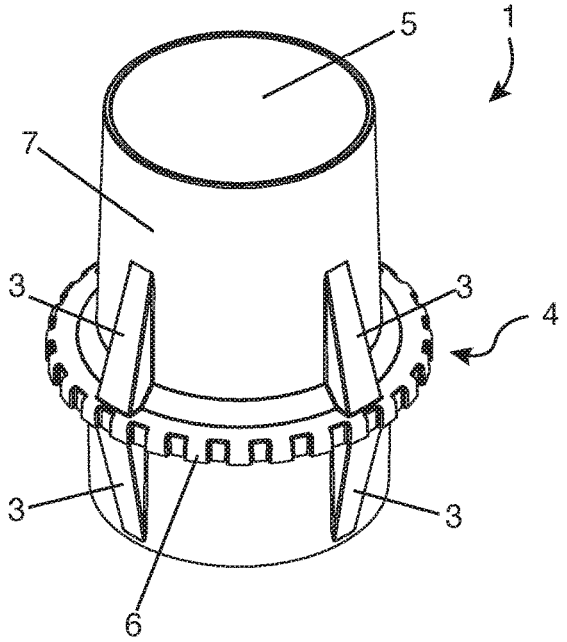
FIG. 2A. Perspective view of a closure component in certain embodiments.
Figure 2B:
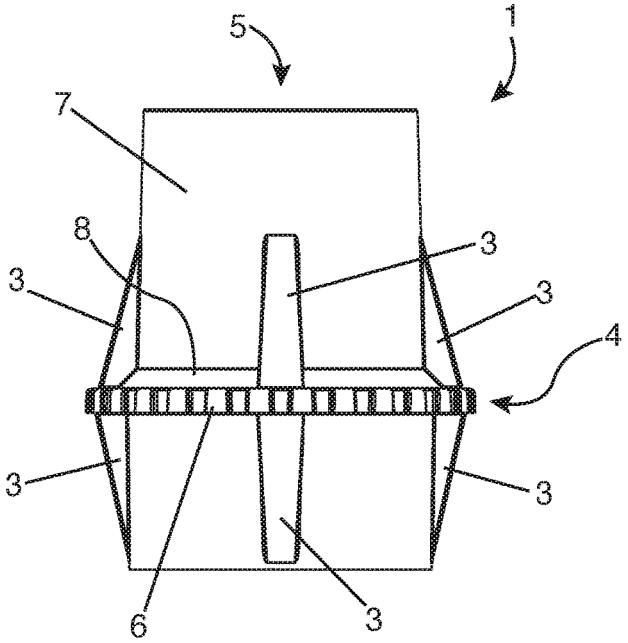
FIG. 2B. Side view of a closure component in certain embodiments.

Referring to FIG. 1, showing a perspective view, certain embodiments of the invention include a closure component 1 and a container 2. In certain embodiments, a closure component is a tubular shape, as shown, for example, in FIG. 1. Referring to FIG. 2A and FIG. 2B, showing a perspective view in certain embodiments of a closure component, a closure component 1 has a handle 4 located along a perimeter of a closure component body 7. In certain embodiments, a handle 4 has an outer perimeter having ridges 6. It will be appreciated that the handle 4 may have other features such as a smooth outer surface, knurling, ribbing, ridges, etc., or one additional layer or more of material such as rubber, foam, silicone, etc., allowing increased gripping of the handle. Referring to FIG. 2A, FIG. 2B, FIG. 3, FIG. 5, and FIG. 6, one or more fins 3 extend from a handle 4 towards an inferior and a superior region of a body 7. In general, such fin may be oriented along a longitudinal direction of a component in certain embodiments, as shown for example in FIG. 2A, FIG. 2B, FIG. 3, FIG. 5, and FIG. 6. In other embodiments, such fin may be oriented spirally around a component. In certain embodiments, handling and/or opening or closing of an assembly is accomplished by holding a fin 3 and/or a handle 4 of a closure component 1, and further rotating the closure component 1 relative to a container 2. It will be appreciated that in certain embodiments, having an external structure, such as one or more fins 3 allows easier opening and closing of a closure component 1. In certain embodiments, a chamfer 8 between one edge of a handle 4 and a body 7 introduces further rigidity to a handle on a body, as shown in FIG. 2B.

Figure 3:
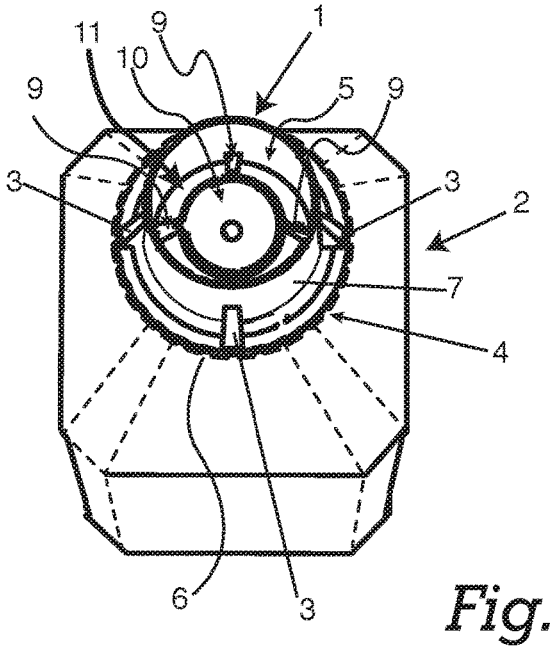
FIG. 3. Top-down perspective view of a container and a closure component in certain embodiments.
Figure 4A:
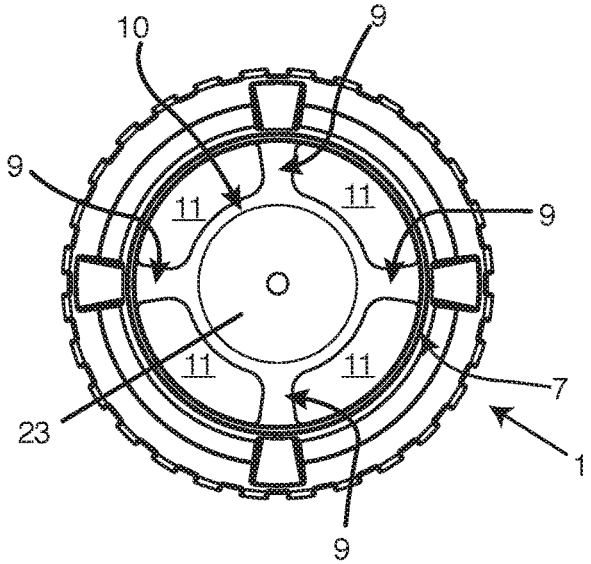
FIG. 4A. Top-down view of a closure component in certain embodiments.
Figure 4B:
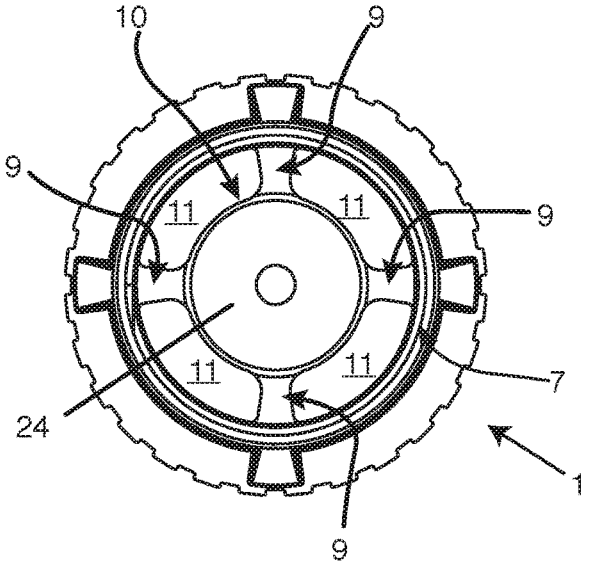
FIG. 4B. Bottom-up view of a closure component in certain embodiments.

In certain embodiments, when an assembly is opened, a fluid is passed through an opening of a closure component. In certain embodiments, a closure component has an attachment end, for example, a thread 22 as shown for example in FIG. 5 and FIG. 6 that allows attachment to a container. Referring to FIG. 2A, FIG. 2B, and FIG. 3 a closure component 1, in certain embodiments, has an opening 5 where fluid may be poured out when such closure component 1 is opened relative to a container 2. Referring to FIG. 3, FIG. 4A and FIG. 4B, embodiments of a closure component body 7 has an inner cap 10 further connected to an inner aspect of a body 7 through ribs 9. One or more ribs 9 connects an inner cap 10 and a wall of a body 7, forming one or more vents 11 in an area between an inner cap 10 and an inner aspect of a body 7. In certain embodiments, at least one vent is included in a closure component, and in certain embodiments, four vents 11 are included in a closure component 1, as exemplified in FIG. 4A and FIG. 4B.

Figure 5:
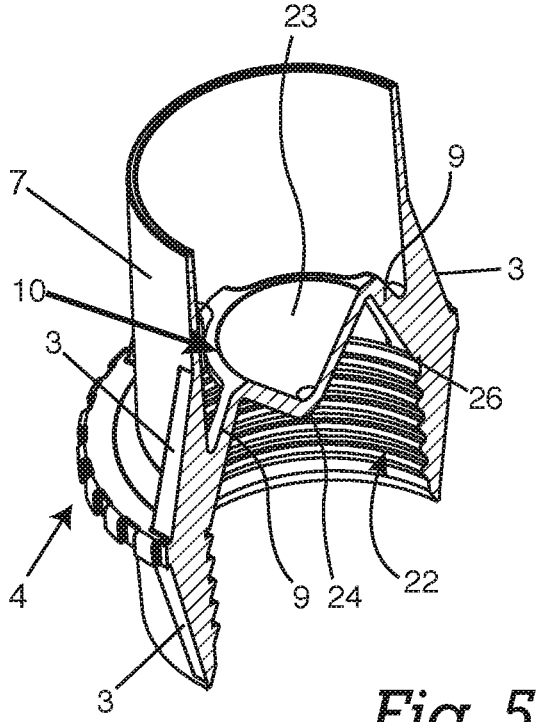
FIG. 5. Cross-sectional, perspective view of a closure component in certain embodiments.
Figure 6:
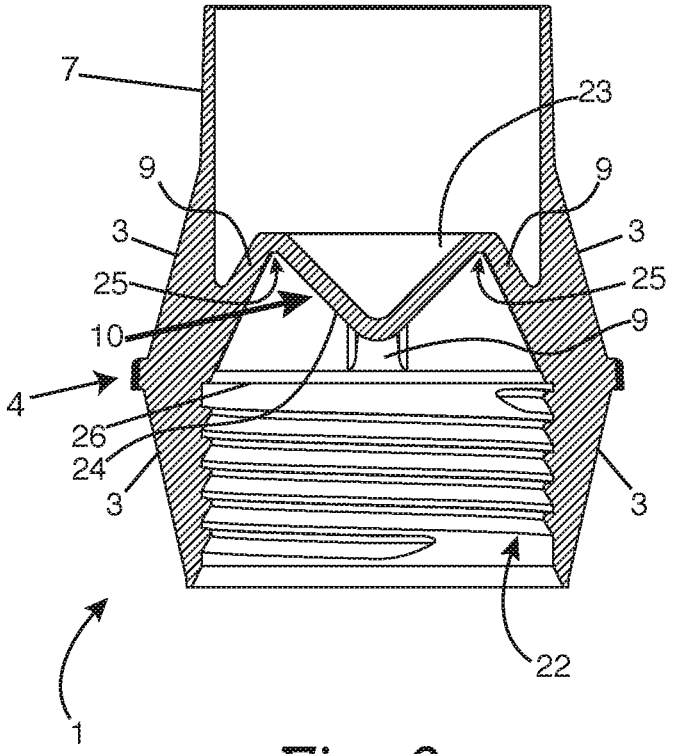
FIG. 6. Cross-sectional view of a closure component in certain embodiments.

Referring to FIG. 4A showing a top-down view, FIG. 4B showing a bottom-up view, FIG. 5 showing a cross-sectional perspective view, and FIG. 6 showing a cross-sectional side view of a closure component 1, certain embodiments of an inner cap 10 have a lower surface 24 and an upper surface 23 having a certain shape. Exemplary shapes include, but are not limited to, conical, hemispherical, spherical, cylindrical, cuboidal, prismal, pyramidal, and irregular. In certain embodiments, referring to FIG. 5 and FIG. 6, an inner cap 10 has a lower surface 24 with a generally conical shape, and an upper surface 23 also having a generally conical shape. In embodiments, such lower surface 24 and upper surface 23 may have a shape that is similar. Still referring to FIG. 5 and FIG. 6, in certain embodiments, a plurality of ribs 9 attaches an inner cap 10 to an inner aspect of a body 7.

Figure 7A:
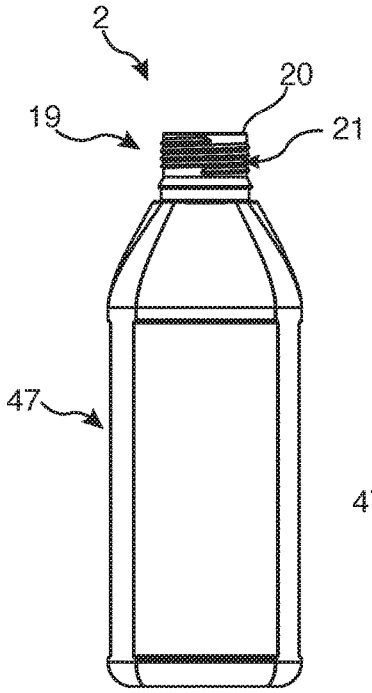
FIG. 7A. Side view of a container in certain embodiments

In certain embodiments, a closure component 1 is threadably attached to and detached from a container 2. Referring to FIG. 5 and FIG. 6, in certain embodiments, a closure component body 7 has a ridge 26 above the threads 22, where in certain cases, such ridge 26 prevents further advancement of a closure component 1 when the threads 22 are engaged with, for example, threads 21 found on a neck 19 of a container 2, 45 as shown, for example, in FIG. 7A, FIG. 7B, FIG. 7C and FIG. 9. In certain embodiments, a container body 47 has a shape that allows storage of a fluid as exemplified in FIG. 7A, FIG. 7B and FIG. 7C. It will be appreciated by those skilled in the arts that a container having any number of characteristics, including but not limited to any shape, size, conformation, material, material composition may be used; certain embodiments of a container are not limited to designs disclosed herein.

Figure 7B:
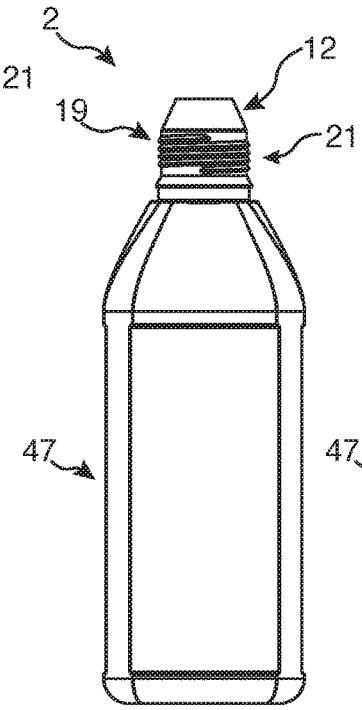
FIG. 7B. Side view of a container and a nozzle collar in certain embodiments.
Figure 7C:
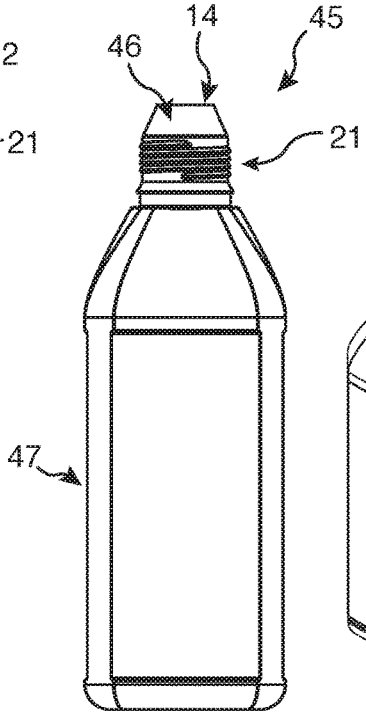
FIG. 7C. Side view of a container comprising a tapered head in certain embodiments.
Figure 7D:
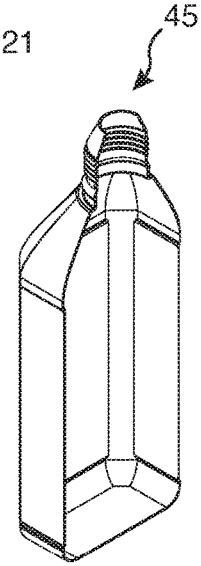
FIG. 7D. Cross-sectional, perspective view of a container having a tapered head in certain embodiments.
Figure 8A:
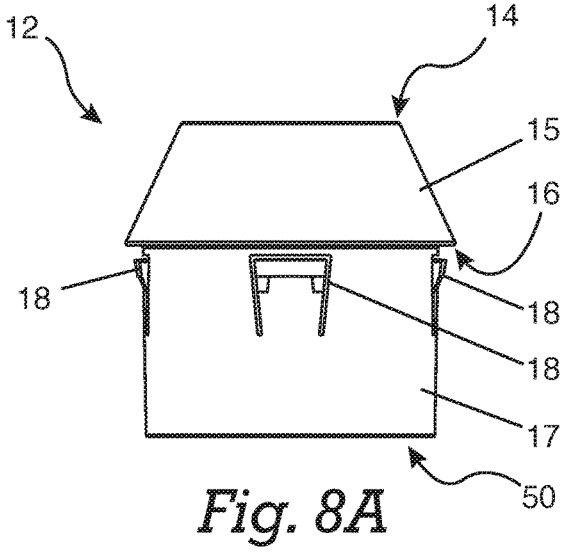
FIG. 8A. Side view a nozzle collar in certain embodiments.

In certain embodiments, a container 45, as shown in FIG. 7C and FIG. 7D has a neck portion further comprising a tapered head 46 and threads 21. In certain embodiments, a container can be produced as a single piece, one shot, straight pull, rapid injection molding. In certain embodiments, a nozzle collar is adaptable to other existing or newly manufactured containers, allowing use in any number of containers found in existence. In certain embodiments, nozzle collar 12, shown attached to a container neck 19, as shown for example in FIG. 7B, also allows control of fluid flow when functioning with a closure component 1. Referring to FIG. 8A showing a side view, certain embodiments of a nozzle collar 12 have a tapered head 15, and a collar body 17. It will be appreciated that in certain embodiments of a container 45 having a tapered head 46 as shown in FIG. 7C or FIG. 7D, or a nozzle collar 12 further comprising a tapered head 15 and attached to a container 2 as shown in FIG. 7B, are used with a closure component 1 to act as a valve for fluid pouring.

Figure 8B:
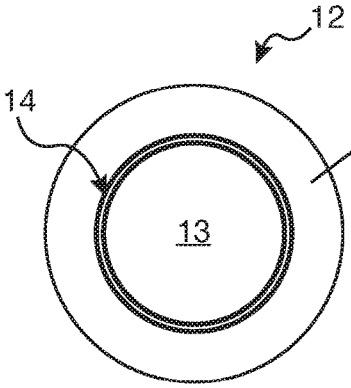
FIG. 8B. Top-down view of a nozzle collar in certain embodiments.
Figure 8C:
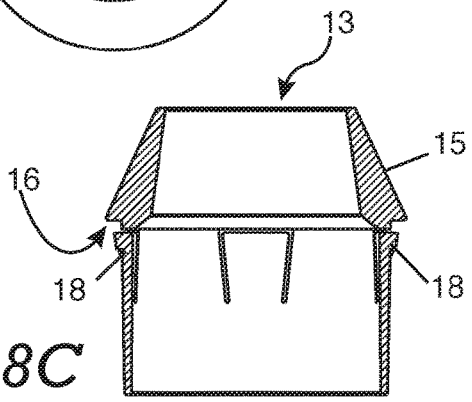
FIG. 8C. Cross-sectional side view of a nozzle collar in certain embodiments.
Figure 9:
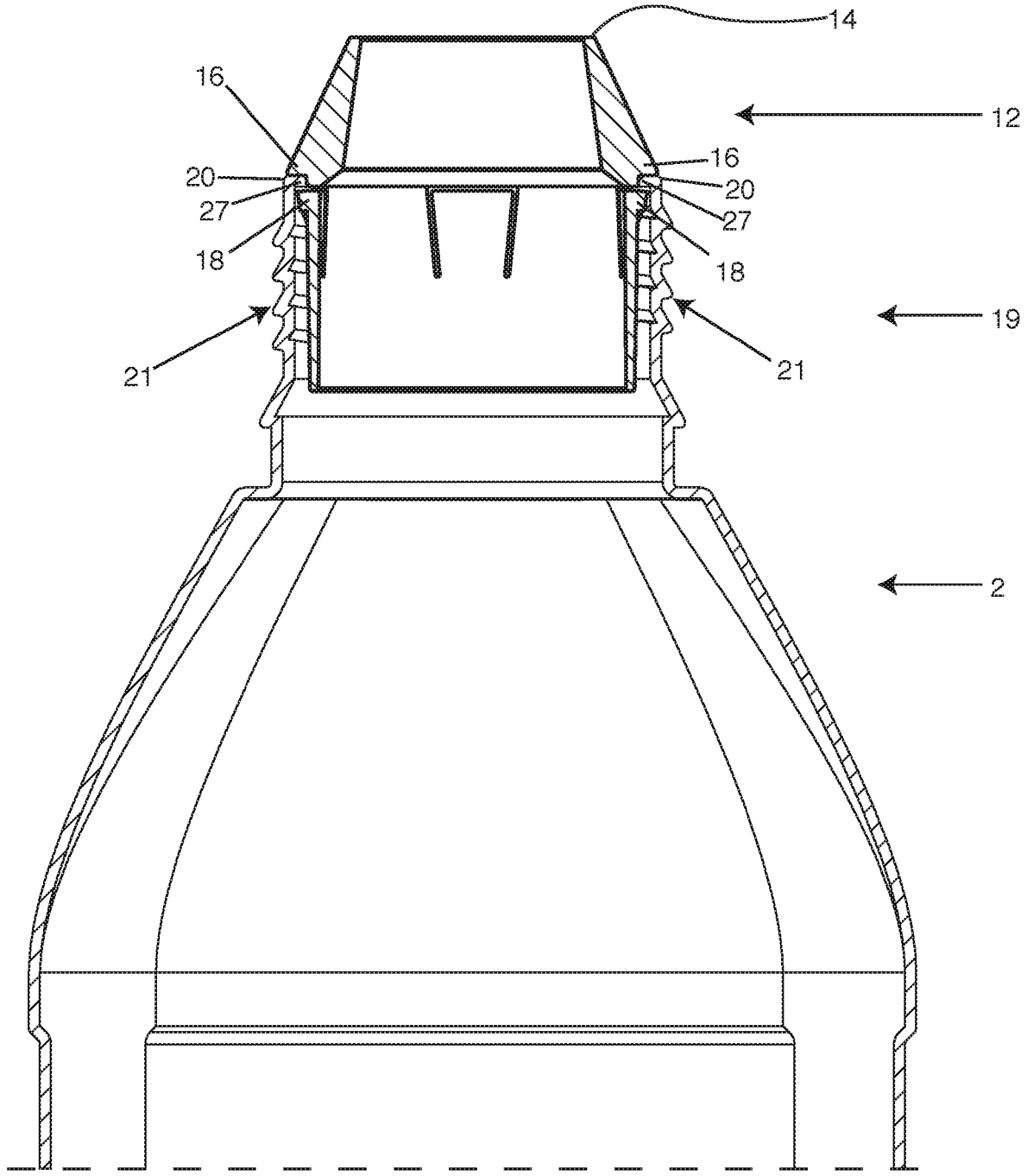
FIG. 9. Cross-sectional side view of a nozzle collar attached to a container in certain embodiments.

Referring to FIG. 9 showing a side cross-sectional view of an embodiment, a nozzle collar 12 attaches to a neck 19 portion of a container 2. Referring to FIG. 8A, and FIG. 8C, in certain embodiments, a collar body 17 has one or more locking features 18 configured to form a snap fit with a container neck 19. In certain embodiments, locking features 18 form a snap fit with an inner rim 27 of a lip 20, further shown in FIG. 9. In certain embodiments, containers being manufactured can be modified to fit a nozzle collar, for example, by including an inner rim 27. standard container. Still referring to FIG. 8A and FIG. 8C, a nozzle collar has a tapered head 15 having an overhang 16, where such overhang 16 interfaces an upper aspect of a lip 20 of a container neck 19, as further shown the example in FIG. 9. In certain embodiments, locking features 18 create a locking fit between a nozzle collar 12 and an inner portion of a neck 19. It will be appreciated that in certain embodiments, locking features may come in a variety of sizes and shapes, the general purpose to secure a nozzle collar to a container neck 19. In certain embodiments, a collar body 17 forms an interference fit with an inner portion of a container neck 19.

Figure 13A:
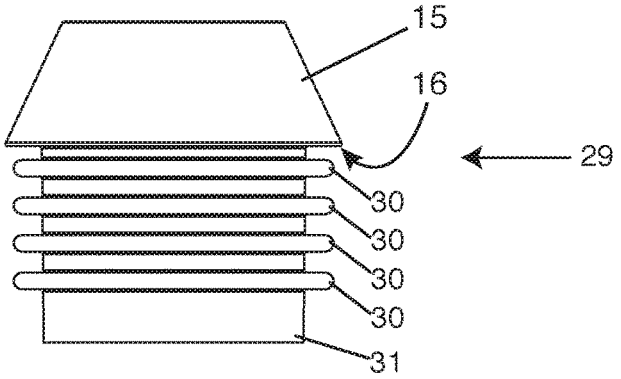
FIG. 13A. Side view a nozzle collar in certain embodiments.
Figure 13B:
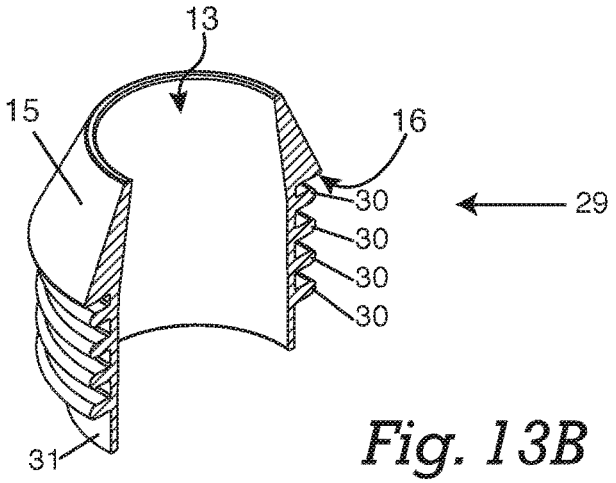
FIG. 13B. Cross-sectional, perspective view of a nozzle collar in certain embodiments.
Figure 14:
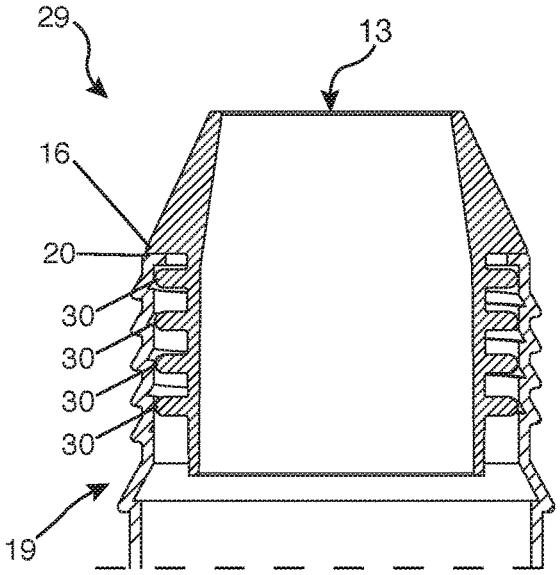
FIG. 14. Cross-sectional, side view of a nozzle collar attached to a container in certain embodiments.
Figure 13C:
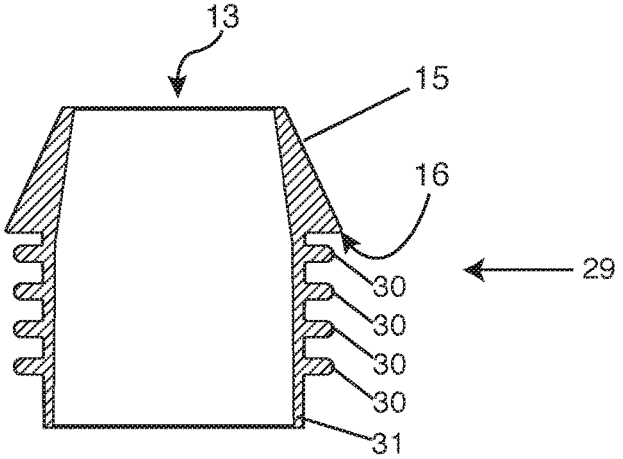
FIG. 13C. Cross-sectional, side view of a nozzle collar in certain embodiments.

A nozzle collar, in certain embodiments, is attached to container neck 19 in a number of different ways. Certain embodiments, such as shown in FIG. 13A, FIG. 13B, and FIG. 13C, a nozzle collar 29 has a tapered head 15, further forming an overhang 16. Referring to FIG. 14, such overhang 16 interfaces an upper aspect of a lip 20 of a container. Still referring to FIG. 13A, FIG. 13B, and FIG. 13C, in certain embodiments, a collar body 31 having annular ribs 30 on an exterior portion of such collar body 31, mitigates movement of a nozzle collar 29 when placed in container neck 19 as shown in FIG. 14. In certain embodiments, the nozzle collar is a single material. In certain embodiments, the nozzle collar comprises more than one material, for example, where portions of the nozzle collar, for instance the annular ribs, is a different material than a collar body and head. It will be appreciated that in certain embodiments, annular ribs may be a series of annular shapes attached on an exterior portion of a collar body, such collar body further having surface features such as grooves to accommodate a shape of such annular rib.

Figure 15A:
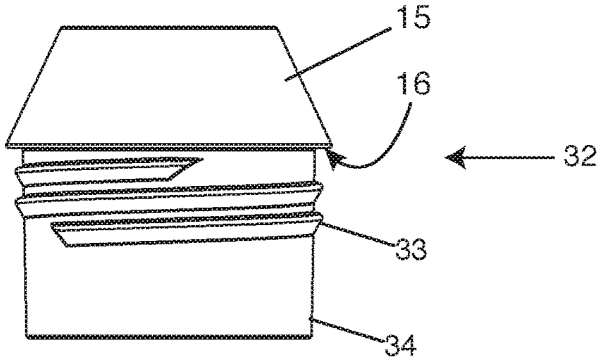
FIG. 15A. Side view a nozzle collar in certain embodiments.
Figure 15B:
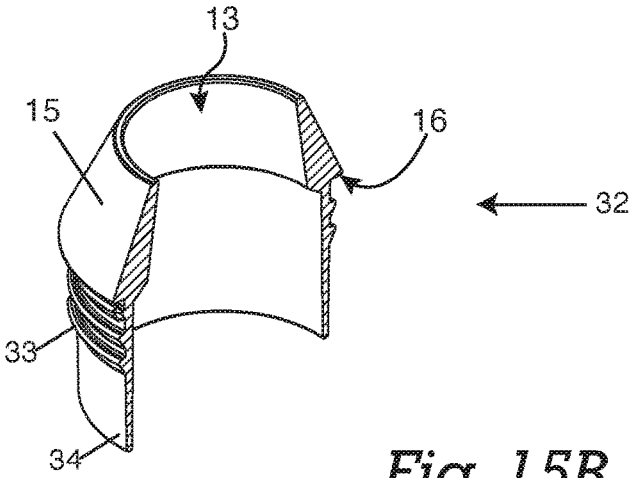
FIG. 15B. Cross-sectional, perspective view of a nozzle collar in certain embodiments.
Figure 16:
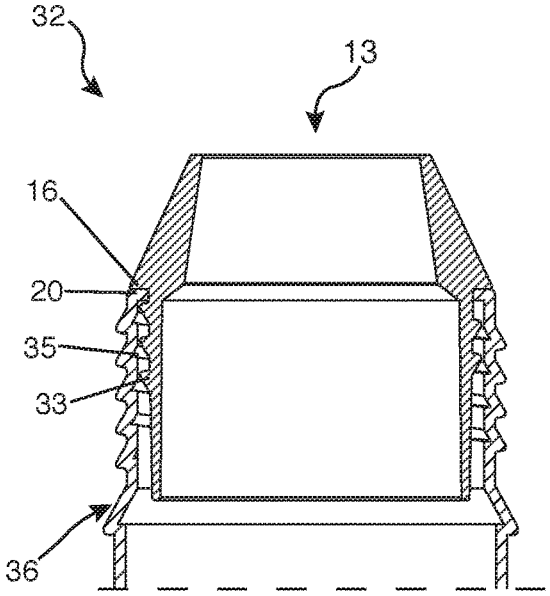
FIG. 16. Cross-sectional, side view of a nozzle collar attached to a container in certain embodiments.
Figure 15C:
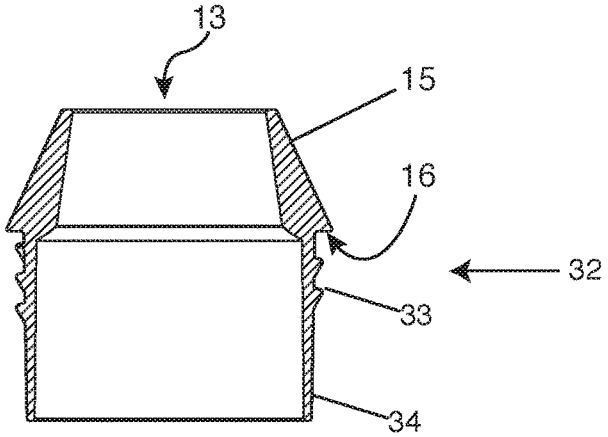
FIG. 15C. Cross-sectional, side view of a nozzle collar in certain embodiments.

Referring to FIG. 15A, FIG. 15B, and FIG. 15C, a certain embodiment of a nozzle collar 32 has a tapered head 15, further forming an overhang 16. Referring to FIG. 16, an overhang 16 interfaces an upper aspect of a lip 20 of a container. Referring to FIG. 15A, FIG. 15B, and FIG. 15C, in certain embodiments, a collar body 34 having an external thread 33 engages with an interior thread 35 of a container neck 36, as further shown in FIG. 16, where threading a nozzle collar 32 in such container neck 36 mitigates movement.

It will be appreciated that, in general, a nozzle collar placed in a container neck, as exemplified in FIG. 9, FIG. 14, and FIG. 16 minimizes fluid flow between an overhang 16 of such nozzle collar and a lip 20 of such container, thereby directing flow of a fluid through a nozzle collar opening 13. Referring to FIG. 9, FIG. 14, and FIG. 16, an overhang 16 interfaces an upper aspect of a lip 20 of a container neck 19. In certain embodiments, an interface between a nozzle collar 12 and a container 2 has a fit preventing flow of liquid between such interface. For instance, such interface may have any number of materials, including, but not limited to a gasket or adhesive to prevent fluid flow between such interface. In certain embodiments, any number of processes may be applied during manufacturing of certain embodiments, including but not limited to soldering, welding, plastic or fusion, such that fluid flow between a nozzle collar and container is prevented. Referring to embodiments of FIG. 8B, FIG. 8C, FIG. 13B, FIG. 13C, FIG. 14, FIG. 15B, FIG. 15C, and FIG. 16, a nozzle collar 12, 29, 32 is a form resembling a tube, where a fluid can pass through an opening 13.

Figure 10:
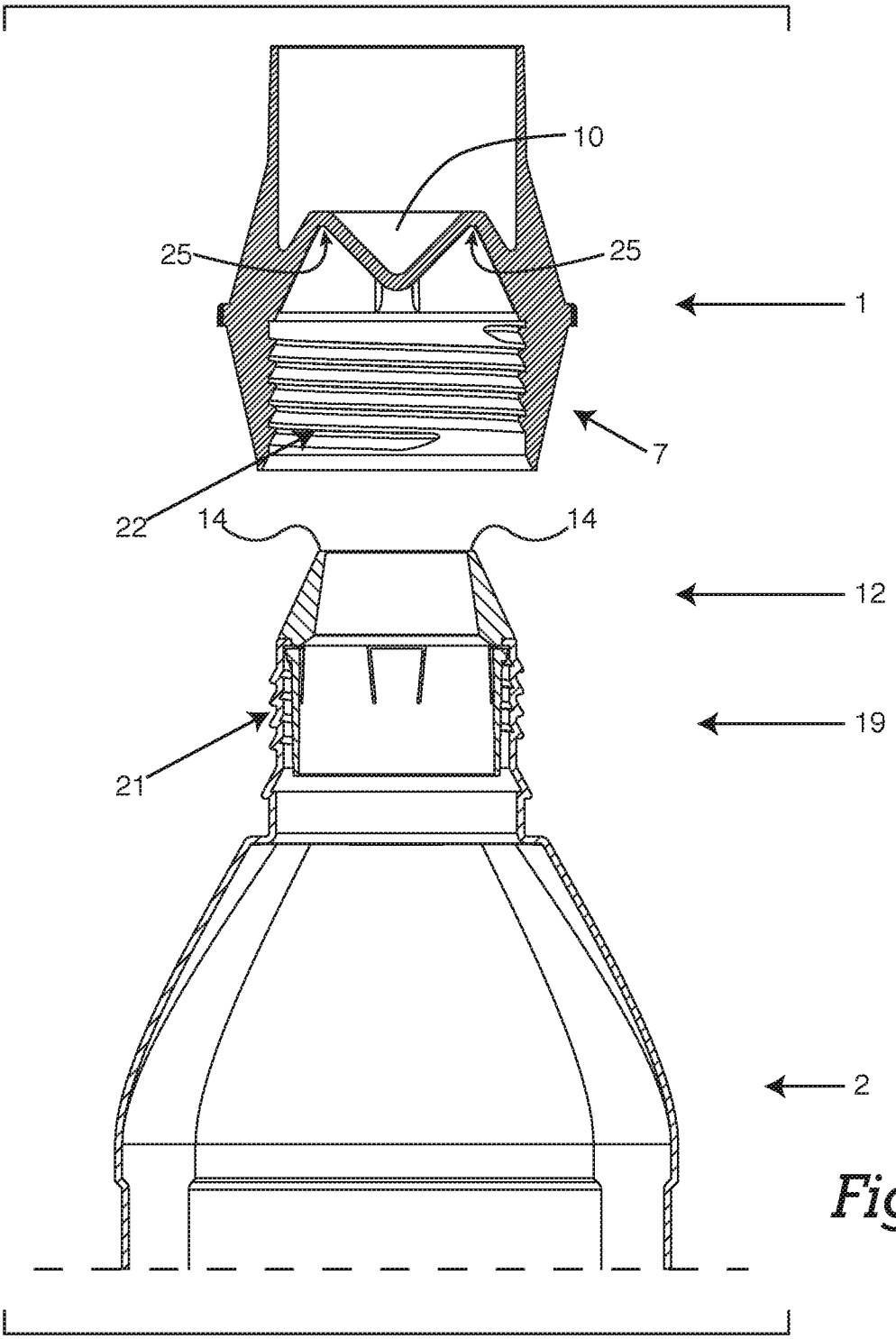
FIG. 10. Cross-sectional, exploded, side view of a container, nozzle collar, and a closure component in certain embodiments.

Referring to FIG. 10, an inner thread 22 located on a distal end of a closure component body 7, engages with an outer thread 21 on a container neck 19, thereby allowing a closure component 1 to be fastened to a container 2. An inner cap 10 of a closure component 1, as shown in FIG. 6 and FIG. 10, further has a surface 25 that interfaces, and forms a seal with a collar lip 14 located on an upper region of a nozzle collar, as shown in FIG. 10. It will be appreciated that a lip 14 is generally found on an upper portion of a tapered head 15 or 46, including for example, on a container 45 as shown in FIG. 7C or on a nozzle collar, as shown in FIG. 8A and FIG. 8B. Further referring to FIG. 11A showing a closed configuration, when a closure component 1 is closed, a seal 28 is formed between a surface and a lip, preventing flow of a fluid past such seal. In this manner, when a closure component 1 is closed as shown in FIG. 11A, fluid in a container is prevented from flowing out. It will be appreciated that in certain embodiments, a surface 25 and/or lip 14 further comprise a material having gasketing properties to augment a seal, for example, including but not limited to a rubber gasket, silicone gasket, physical grooves, a ring made of any number of materials such as plastic.

Figure 11C:
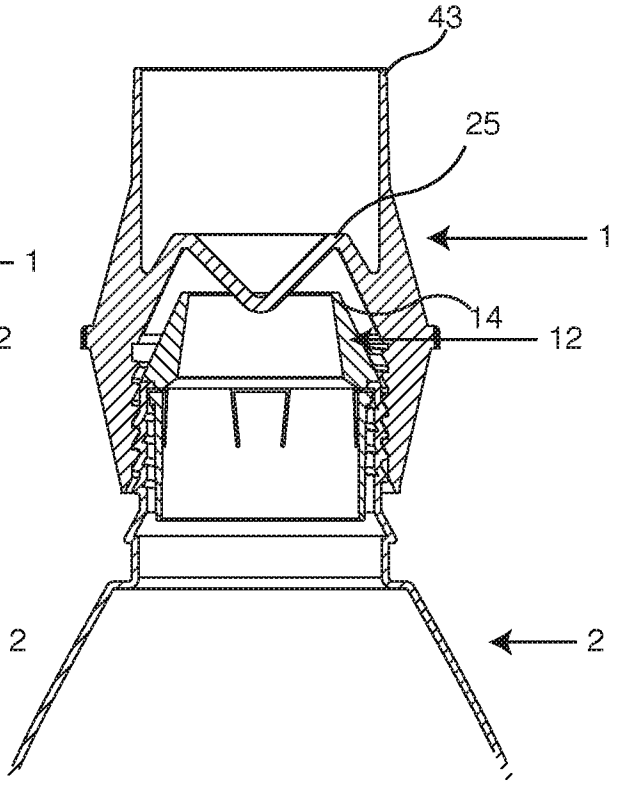
FIG. 11C. Cross-sectional, side view of a container, nozzle collar, and a closure component, where a closure component is opened, in certain embodiments.
Figure 11B:
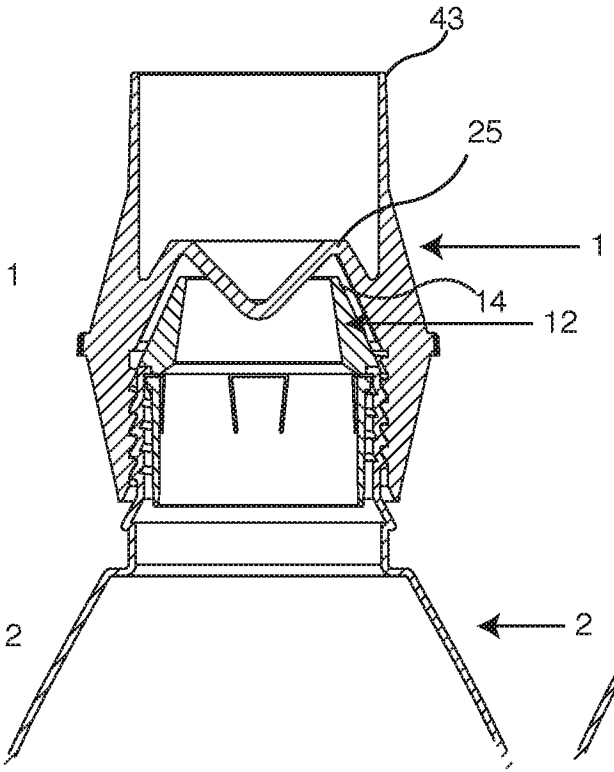
FIG. 11B. Cross-sectional, side view of a container, nozzle collar, and a closure component, where a closure component is opened, in certain embodiments.
Figure 11A:
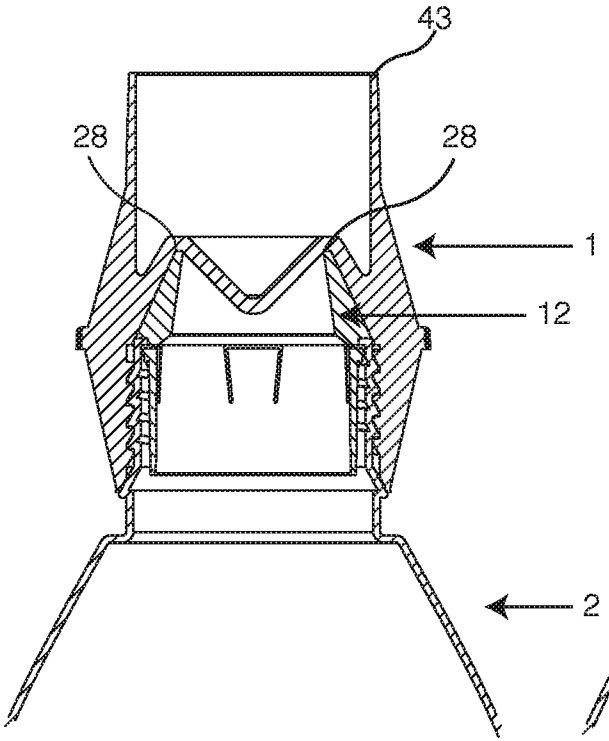
FIG. 11A. Cross-sectional, side view of a container, nozzle collar, and a closure component, where a closure component is fully closed, in certain embodiments.

Referring to FIG. 11B and FIG. 11C showing an open configuration, when a closure component is opened, a seal between a surface 25 and a lip 14 is broken, allowing fluid inside a container 2 to pass a surface 25 and lip 14 interface. In one example, opening a closure component 1 a greater amount, as exemplified in FIG. 11C, would allow for greater flow of a fluid past such surface 25 and lip 14 interface, than compared to opening a closure component 1 a smaller amount, as exemplified in FIG. 11B. It will be appreciated that by controlling the degree to which a closure component 1 is opened, a user can control the rate at which a fluid is flowed from a container to the exterior. It will be appreciated that a closure component 1 as shown in FIG. 11A, FIG. 11B, and FIG. 11C, may be used with a container 45 having a tapered head, as exemplified in FIG. 7C and FIG. 7D.

Certain embodiments of the present disclosure allow a user to pour a fluid using two hands. For instance, a user may handle a closure component 1 with one hand, and handle a container 2 with another hand. A user may invert the entire assembly with a closure component 1 in a closed position as shown for example in FIG. 11A. A user may direct a rim 43, located on a proximal end of a closure component 1 adjacently to a reservoir opening. Then, a user may turn a closure component 1 to a more open position, as illustrated in FIG. 11B or FIG. 11C, breaking a seal between a surface 25 and lip 14, and allowing fluid to flow out of a collar opening 13, past a component vent 11, and passing a component opening 5. Simultaneously, air flowing in through vents 11 displaces the fluid flowing out of a container 2 advantageously allowing a quicker transfer of such fluid. A user may hold a handle 4 and/or fins 3 to open or close a closure component 1. In certain embodiments, the degree in which a user has opened or closed a closure component 1 relative to a nozzle collar allows such user to regulate the flow of a fluid; further opening or further closing a closure component increases or decreases the rate at which a fluid flows out. In one aspect, a plurality of vents 11 located in a closure component 1 allows air to displace a fluid flowing out, and further increasing the rate of transfer of a fluid. It will be appreciated that a container 45 having a tapered head 46 may also be used in the examples shown in and described for FIG. 11A, FIG. 11B, and FIG. 11C.

In one aspect, the general shape of an inner cap 10 having a lower surface 24 with a conical shape, as exemplified in certain embodiments in FIG. 6, allows fluid to flow against the lower surface 24; such conical shape allows fluid to be directed towards one or more of the vents 11. Advantageously, such conical form found in certain embodiments allows rapid flow of a fluid, because the lower surface acts to direct the fluid towards the vents.

It will be appreciated that in certain embodiments, the rim 43 of a closure component body 7, as shown for example in FIG. 11A, FIG. 11B, and FIG. 11C, may have a different diameter than that of the rest of the body 7. It will be appreciated that in certain embodiments, the rim 43 may be a form that is a different shape, for example, teardrop, triangle, square, or elliptical.

Certain embodiments of the present invention address issues with existing enclosure systems. For example, the U.S. Patent Publication Application No. 2009/0084752 A1 (by Coulson) ("Coulson"), incorporated herein by reference in its entirety describes an enclosure system with valve control and flow regulation ability. Coulson describes the use of a restriction element that restricts travel of a closure beyond a maximum opening position. Such restriction element allows the closure to operate only within a predetermined maximum opening position and minimum opening position, providing a user with a narrow scope of operation and flow capacity. Embodiments of the present disclosure have a closure component 1 that can be detached from a container 2. The ability to detach a closure component allows direct pouring of the contents of a container without the need for a closure component, as well as a greater control over the flow rate. Another advantage of a detachable closure component is that it al lows direct refilling of a container, for example, with spent motor oil, so that the container can be transported to a recycling center after its use.

In another example, certain embodiments of the present invention reduce the number of components required to achieve flow regulation. For example, Coulson discloses a component that requires manufacturing of individual pieces further attached together to form a single unit. Certain embodiments of the present disclosure use two components, such as a container 45 (as shown for example in FIG. 7C) and a closure component 1. Other embodiments have three components, such as a container 2, a nozzle collar 12 (as shown for example in FIG. 7B), and a closure component 1. It will be appreciated that a closure component produced as a single piece reduces cost and time of manufacturing and associated materials, and reduces the necessity for steps involved with snapping, gluing, or welding associated with attaching a closure and an inner piece as described by Coulson By reducing steps and/or pieces, certain embodiments of the invention mitigates possible mechanical failure points of Coulsen, providing a more predictable functionality.

Figure 12A:
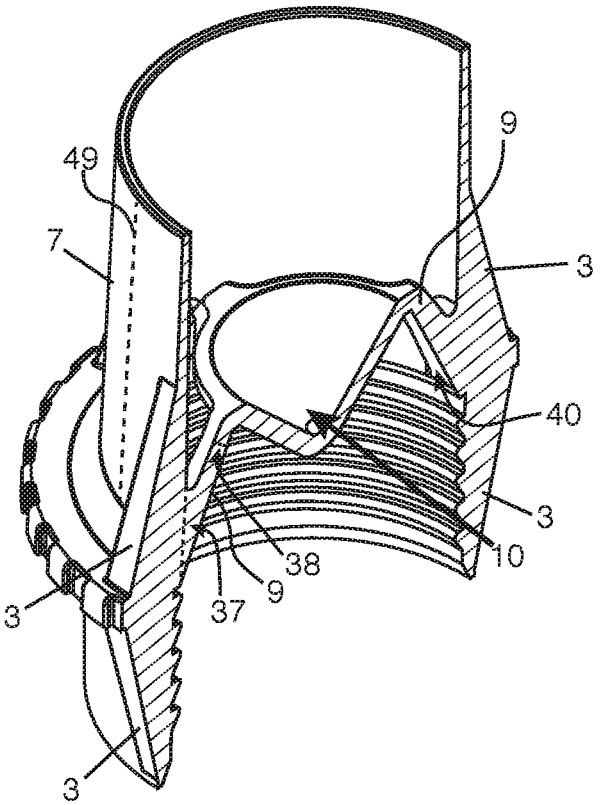
FIG. 12A. Cross-sectional, perspective view of a closure component in certain embodiments.

In certain embodiments, a closure component is a single piece, where certain arrangements, features, portions, etc. are designed to minimize material use. For example, in certain embodiments, a rib 9 has a base 37 that connects to an inner aspect of a body 7, where the length of a rib base 37 connected to a body 7 is greater than the width 38 of the rib 9, as shown for example in FIG. 12A. Further, a base 37 is connected to an area of a body 7 that also has a fin 3, as shown in cross sectional view in FIG. 12A. By adjacently placing a base 37 location to a fin 3, material may be more efficiently used in a closure component, and less material may be used overall, and/or while maintaining an ability to be created as a single unit, for example, as a single injection molded piece.

Figure 12B:
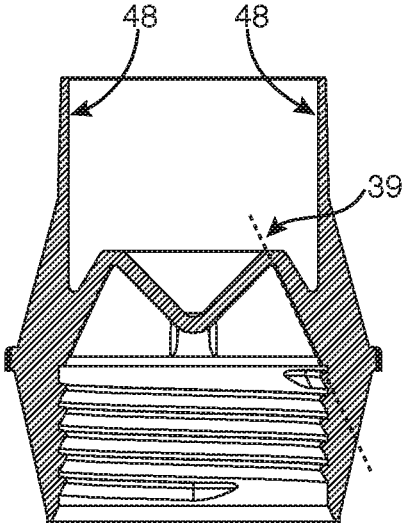
FIG. 12B. Cross-sectional, side view of a closure component in certain embodiments.
Figure 12C:
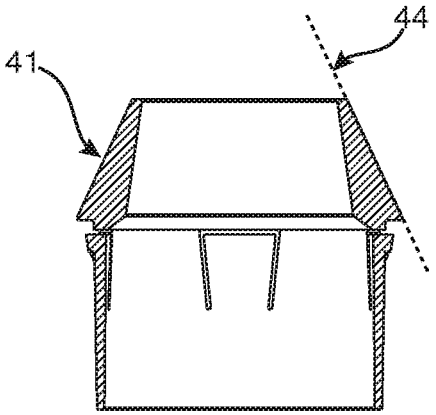
FIG. 12C. Cross-sectional, side view of a nozzle collar in certain embodiments.

Featuring either a tapered head on container 45 or a tapered head on a nozzle collar 12 further attached to a container 2 allows for producing a closure component that is generally cylindrical in shape. It will be appreciated that a tapered head is found on a container 45 shown in FIG. 7C and FIG. 7D, or a nozzle collar 12 as shown for example in FIG. 8A. For instance, in certain embodiments, as shown in example FIG. 8A, a collar 12 comprising a tapered head 15, has a lip 14 that is a diameter smaller than its overhang 16, and the lip 14 is generally smaller than a diameter of an opening 5 of a closure component 1 as referenced, for example, in FIG. 2A. Furthermore, in certain embodiments, an angle 39 (seen in FIG. 12B) of a rib 9 matches the angle 44 (seen in FIG. 12C) of the taper on a tapered head 15 or 46. These features allow a closure component 1 to incorporate at least one rib and an inner cap within the boundaries of a body 7, where such body 7 generally resembles a cylinder in certain embodiments. It will be appreciated that a closure component having a wall 48 that is substantially straight in an axial direction as shown for example in FIG. 12B, provides benefit during manufacturing as it allows a straight-pull of a die during injection molding, allowing for rapid manufacturing and potentially fewer parts.

In certain embodiments, an angle 39 (seen in FIG. 12B) of a rib 9 matches the angle 44 (seen in FIG. 12C) of the taper on a tapered head 15 or 46 of a nozzle collar. While a closure component 1 is in a closed position, a seal 28 (seen in FIG. 11A) formed between a surface 25 on a closure component and a lip 14 of a nozzle collar (seen on FIG. 10) prevents flow of a fluid. Furthermore, certain embodiments have a lower surface 40 of a rib (for example, FIG. 12A) that interfaces with an outer surface 41 of a tapered head 15 (for example, FIG. 12C). The additional surface area provided by that interface further allows the upward force applied from a nozzle collar to the closure component 1 to be distributed not only to the inner cap 10, but also the ribs 9. In a closed position, a downward force applied by the closure component engaging with a container thread 21 further seals an interface between a nozzle collar and a container, for example, seal 20 (as seen in FIG. 9), further preventing leaks and sealing the system.

Existing funnels have a wide diameter opening that is reduced in size to a smaller diameter portion, which reduces the flow of fluid and can cause fluid backup within the funnel. This fluid backup can lead to the center of gravity rising, and the funnel tipping over while a fluid is being poured. This fluid backup may also prevent quick enough flow into a machine reservoir. Certain embodiments of the invention improve upon problems found with funnels, where a closure component body 7 is sized to fit an opening of a machine reservoir (e.g. opening for engine oil). In certain embodiments, the diameter of a closure component rim is between 0.75 inch and 3 inches, as to fit openings of various machine reservoirs. In certain embodiments, the tapering of fins 3 as shown for example in FIG. 2B of a closure component 1 allows only a certain portion of a closure component from entering an opening of a machine reservoir, thereby allowing a user to rest the bottle on such opening, and giving the user more control over opening or closing the valve.

Irregular fluid flow, commonly referred to as "glugging" or "gurgling" caused by the lack of sufficient airflow into a container to replace a vacuum caused by pouring, is further solved by certain embodiments of the invention. It will be appreciated that fluid flow occurs when a seal between a nozzle collar and a closure component, for example, a collar lip 14 and a surface 25, is broken, and the amount in which a closure component is opened has the effect of valve control of a fluid being poured. In certain embodiments, closure component body 7 has a height 49, shown for example in FIG. 12A, that effectively creates a distance, or height 49 between a closure component rim 43 and the valve. Such distance allows a turbulent stream of fluid that pours out of the vents 11 to be less turbulent by the time the fluid reaches the rim 43 and enters a secondary receptacle, for example, an opening of a machine reservoir. The vents 11 of a closure component 1 introduce air flow as fluid is poured. In certain cases while pouring, four separate streams of fluid pass through each vent of a closure component. Together, the configuration in certain embodiments, for example, the vents, and for example, the conical shape of an inner cap, reduce glugging and allow rapid fluid flow.

EXAMPLE

In one example case, the speed of flow of pouring motor oil through a one-pint mechanics oil funnel, or a container having a tapered head and a closure component, was tested. For this test, the assembly that included a container, a nozzle collar, and a closure component was upturned so that the nozzle collar and closure component were located at the bottom. The base of the upturned container was opened, to allow motor oil to be poured through. The closure component was in an open position.

A 315 mL volume of 10W-30 motor oil (Pennzoil), set at room temperature, was placed in a primary receptacle. The primary receptacle was instantly inverted to transfer the motor oil into a secondary receptacle, whereby a one-pint mechanics oil funnel, or a container in one embodiment of the invention was placed directly above the secondary receptacle. The amount of time to transfer the bulk of the motor oil through either the funnel or an embodiment of the invention was recorded. Transfer of the motor oil through the funnel occurred in 3.78 seconds. Transfer of the motor oil through the nozzle collar and closure component occurred in 1.71 seconds. In this example case, use of an embodiment of the invention resulted in an approximately 54% quicker dispensing of fluid as compared to a traditional funnel.

In certain embodiments, the diameter of a collar lip 14 is generally smaller than the diameter of a collar base 50 (for example shown in FIG. 8A). In certain embodiments, a diameter of a collar lip 14 is a similar size as a filler tube neck aperture found at the base of an oil receiver cup. In certain embodiments, such collar lip 14 has a diameter of 0.5 inches to 1 inch. In certain embodiments, such collar lip 14 opening has an area of approximately 0.53 $in^2$. In certain embodiments, such sizing allows the contents of a container to be discharged at a rate that a machine reservoir is able to accept a fluid.

In certain embodiments, a nozzle collar is a separate component that can be attached to a container. It will be appreciated by those skilled in the art that a nozzle collar that can be adapted to other containers already available allows certain embodiments of the invention to be adapted and used for a number of different container types, shapes, sizes; be placed on existing containers in place of normally found caps; be sold separately for retrofitting, among other advantages to existing containers.

Certain embodiments of the invention will be prepared with a fluid, for instance, using a liquid filling machine to fill a container 2 with a fluid. Certain embodiments of the invention will be capped with a nozzle collar and/or a closure component 1, for example, with a capping machine. Certain aspects of embodiments of the invention are automated allowing filling a plurality of containers 2 using one or more automatic or semi-automatic machines and/or processes.

Figure 17A:
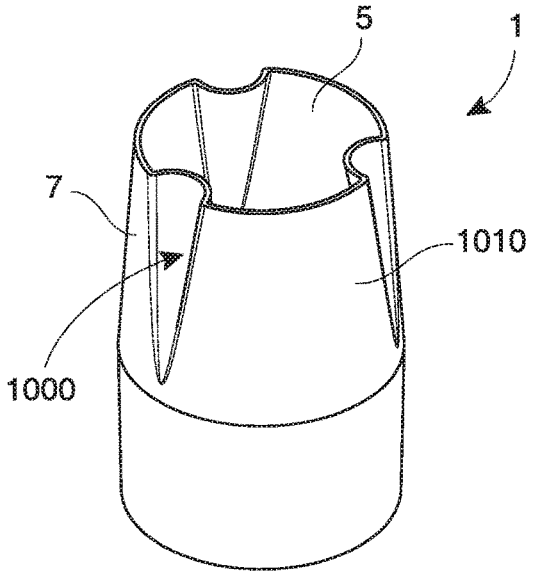
FIG. 17A. Perspective side view of a closure component of certain embodiments.
Figure 17B:
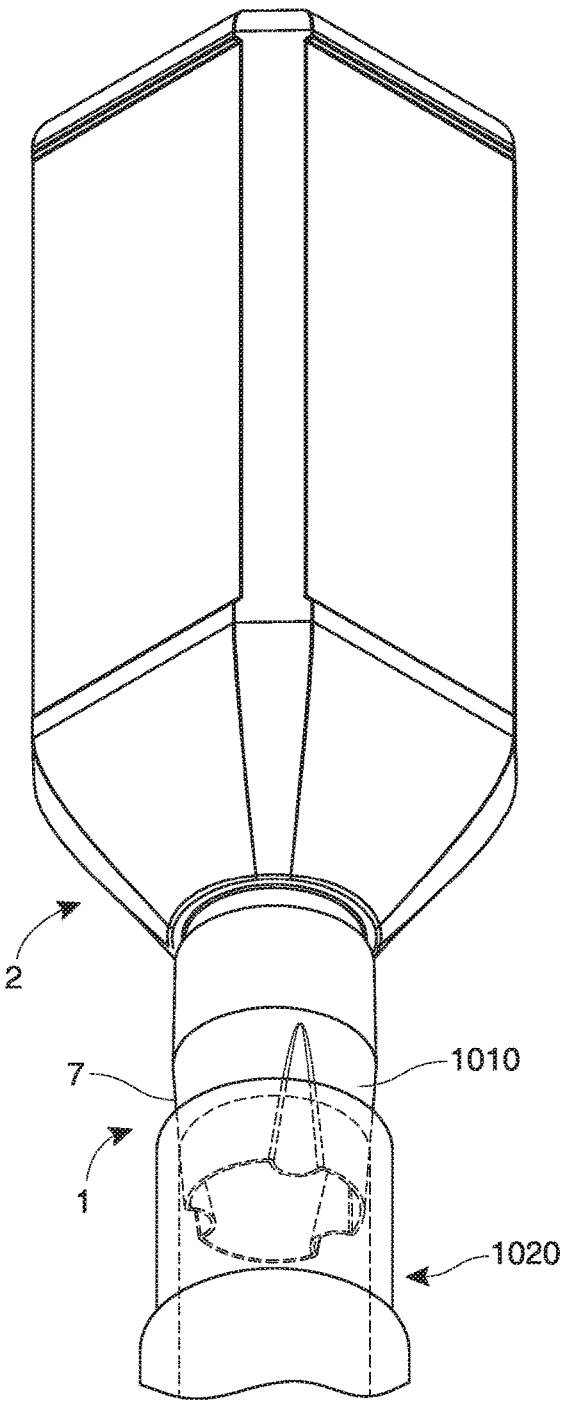
FIG. 17B. Perspective side view of a closure component of certain embodiments affixed to a container engaging with a receptacle.

In certain embodiments, shown in FIG. 17A and FIG. 17B, a closure component 1 further comprises venting grooves 1000 consistent with an exterior surface 1010 of the body. The venting grooves 1000 traverse from a proximal portion of the body 7, toward a more distal portion of the body 7. The venting grooves 1000 provide airflow to prevent between the ambient air and the receptacle 1020 into which a user is pouring a fluid from a container 2. Thus, mitigating scenarios in which a pressure difference develops between the ambient air and the receptacle 1020. Such scenarios in which a pressure difference develops between the ambient air and the receptacle 1020, such as vacuum lock, which prevent the dispensation of fluid from the container 2 as desired.

Figure 18A:
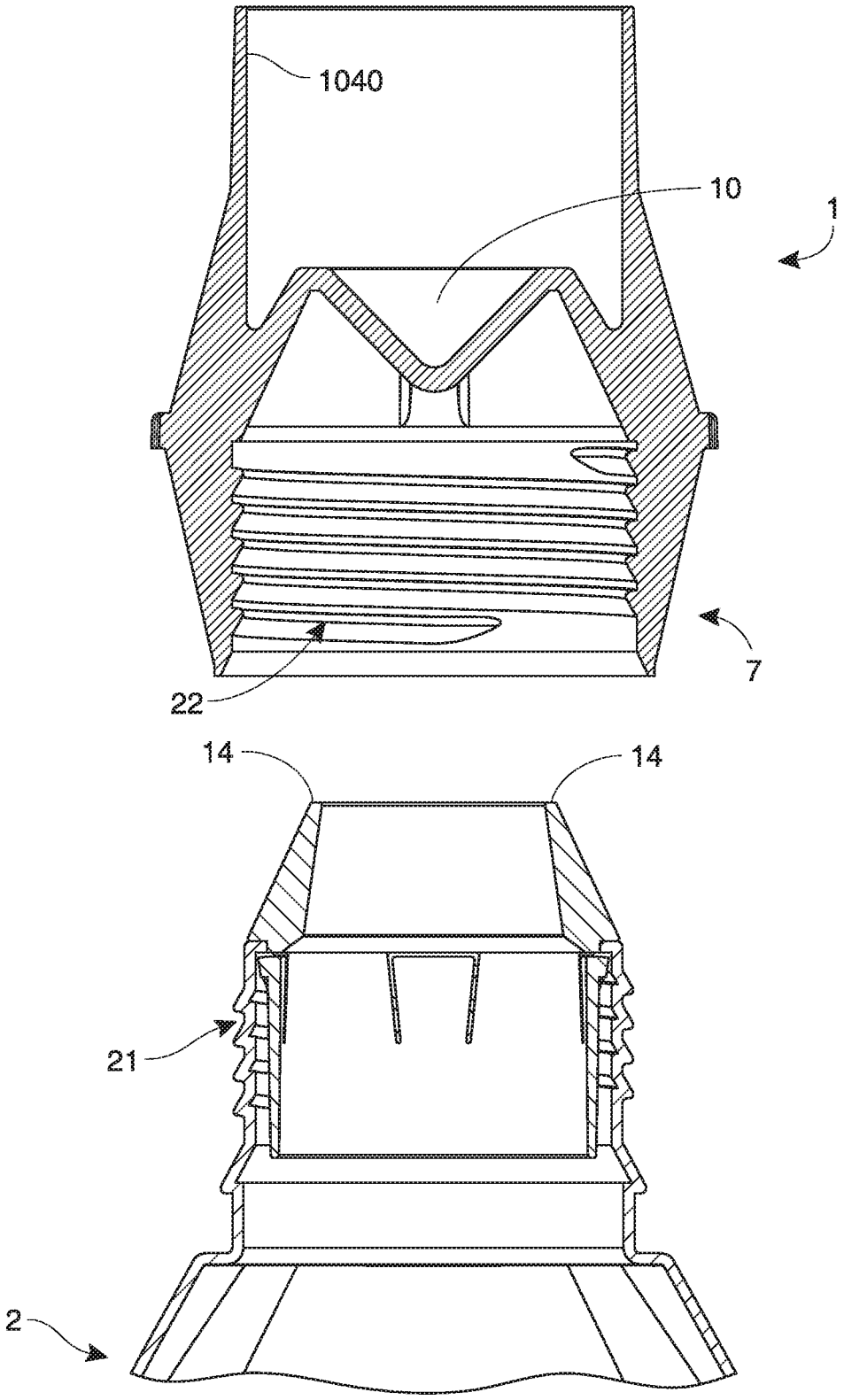
FIG. 18A. Cross sectional side view of a closure component and container of certain embodiments.
Figure 18B:
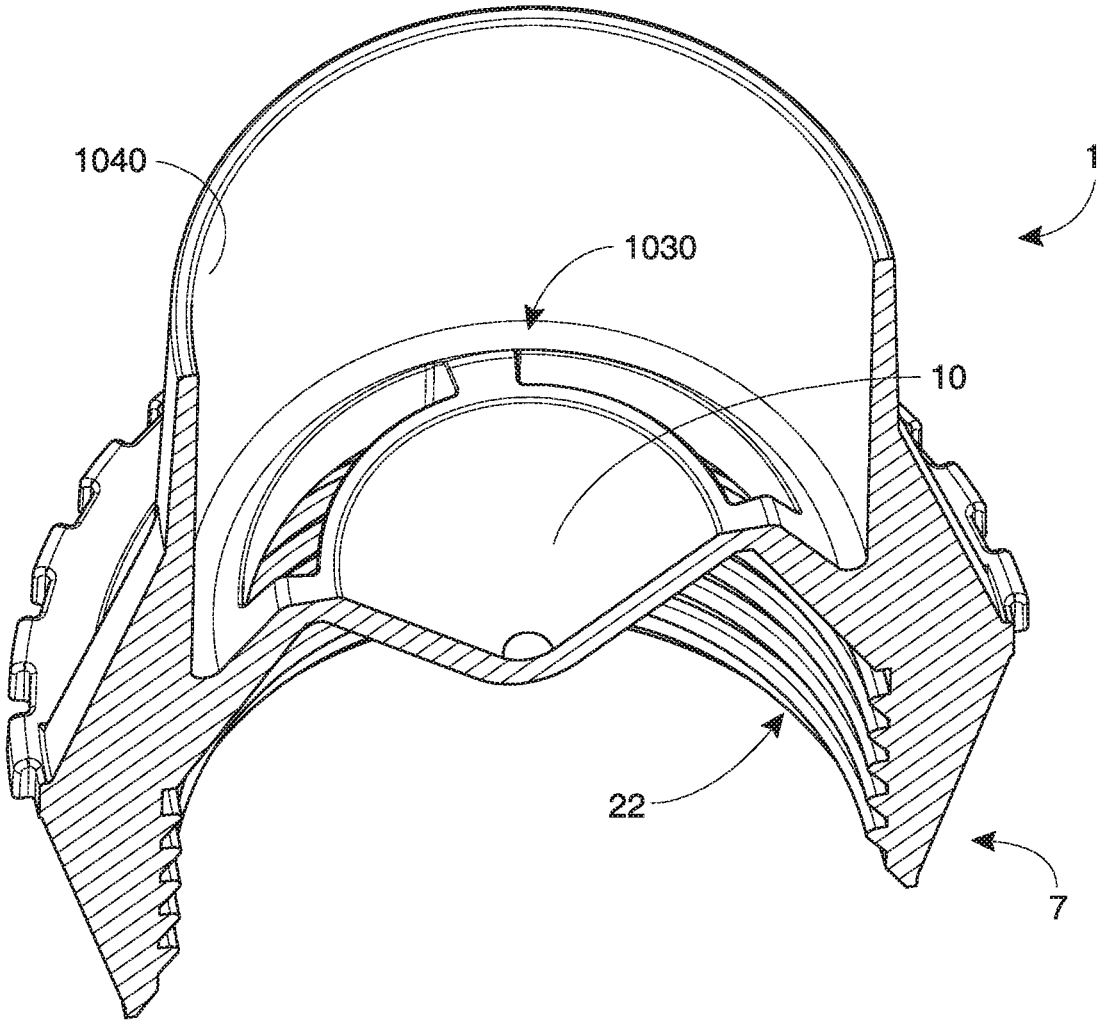
FIG. 18B. Perspective cross-sectional view of certain embodiments of a closure component.

In certain embodiments, such as shown in FIG. 18A-FIG. 18B, a closure component 1 having a body 7, further comprises an annular recess 1030 consistent with an inner surface 1040 of the body, typically distally located from the threads 22 of the body 7. Such an annular recess 1030 serves to retain fluid which has been dispensed from a container 2 which the closure component is attached to. When fluid—such as oil—comes into contact with the threads 22, the oil may cause leakage or impede with the operability of the engagement of a first set of threads 21 to second set of threads 22, which are configured to mate. In certain use cases, a container 2 having a closure component 1 affixed to it is tipped or inverted in order to dispense fluid contained therein. When the container 2 is returned to an upright position, fluid remaining in contact with the inner surface 1040 of the closure component flows downwards toward the inner cap 10 and toward the threads 22 of the body. The annular recess 1030 as disclosed, captures the fluid in contact with the inner surface prior to the fluid traversing into the threads 22 of the closure component.

Figure 19:
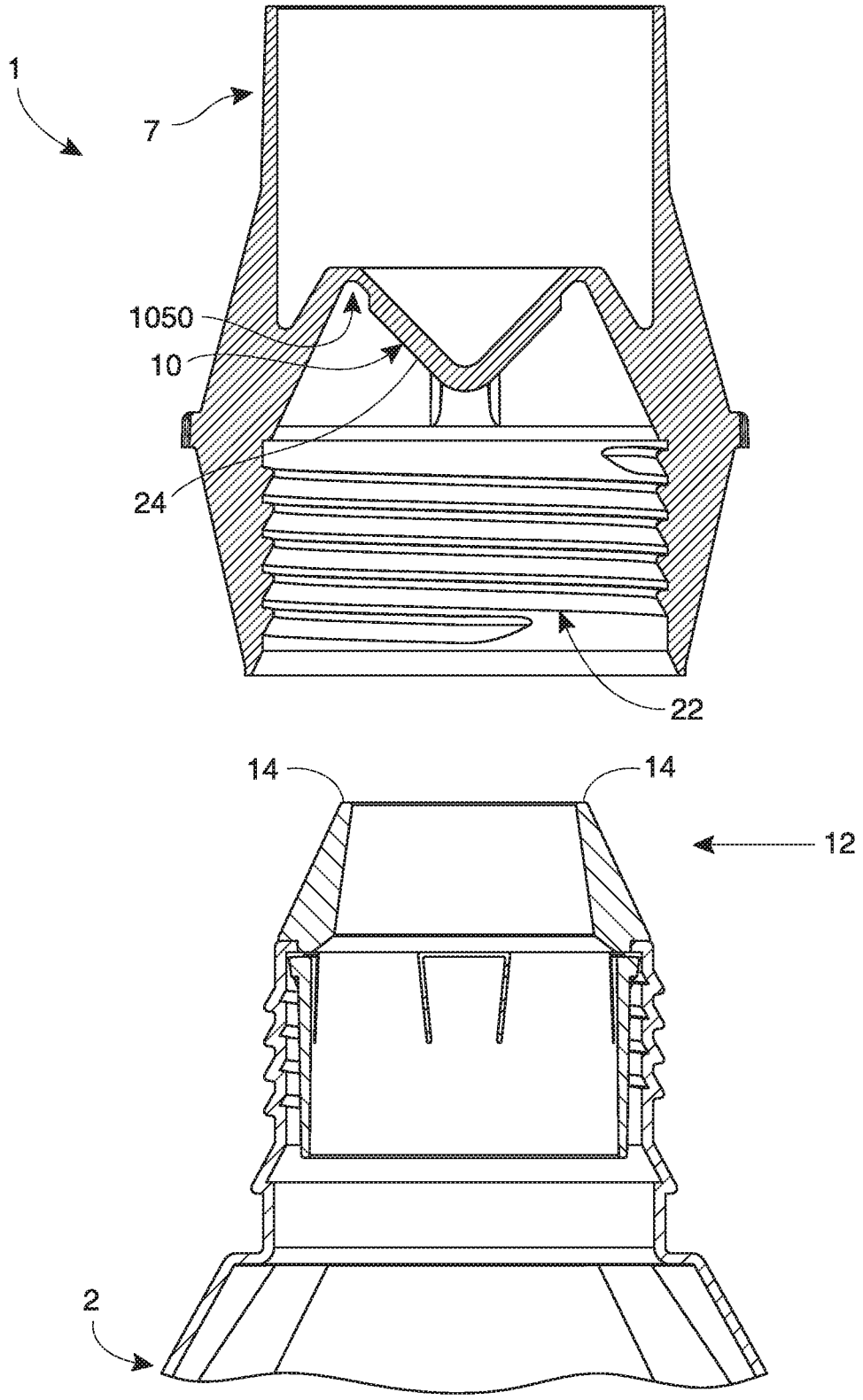
FIG. 19. Cross sectional side view of closure component and container of certain embodiments.

In certain embodiments, such as shown in FIG. 19, an inner cap 10 further comprises an annular groove 1050 consistent with a lower surface 24 of the inner cap. An annular groove 1050 of such embodiments is configured to receive the lip 14 of the nozzle collar 12. When mated, the lip 14 and the annular groove 1050 further prevent the passage of fluid past the seal 28 (FIG. 11A). Actuation of the closure component 1—rotating the body 7 in relation to the nozzle collar 12 in a first direction—places the closure component in a closed configuration resulting in the mating of the lip 14 with the annular groove 1050, thereby sealing the container 2 to which the closure component 1 is affixed to. The closure component 1 can be actuated to an open configuration by rotating the body 7 in a second direction in relation to the nozzle collar 12, thereby separating of the lip 14 from the annular groove 1050 and unsealing the container 2 to which the closure component 1 is affixed to.

Figure 20:
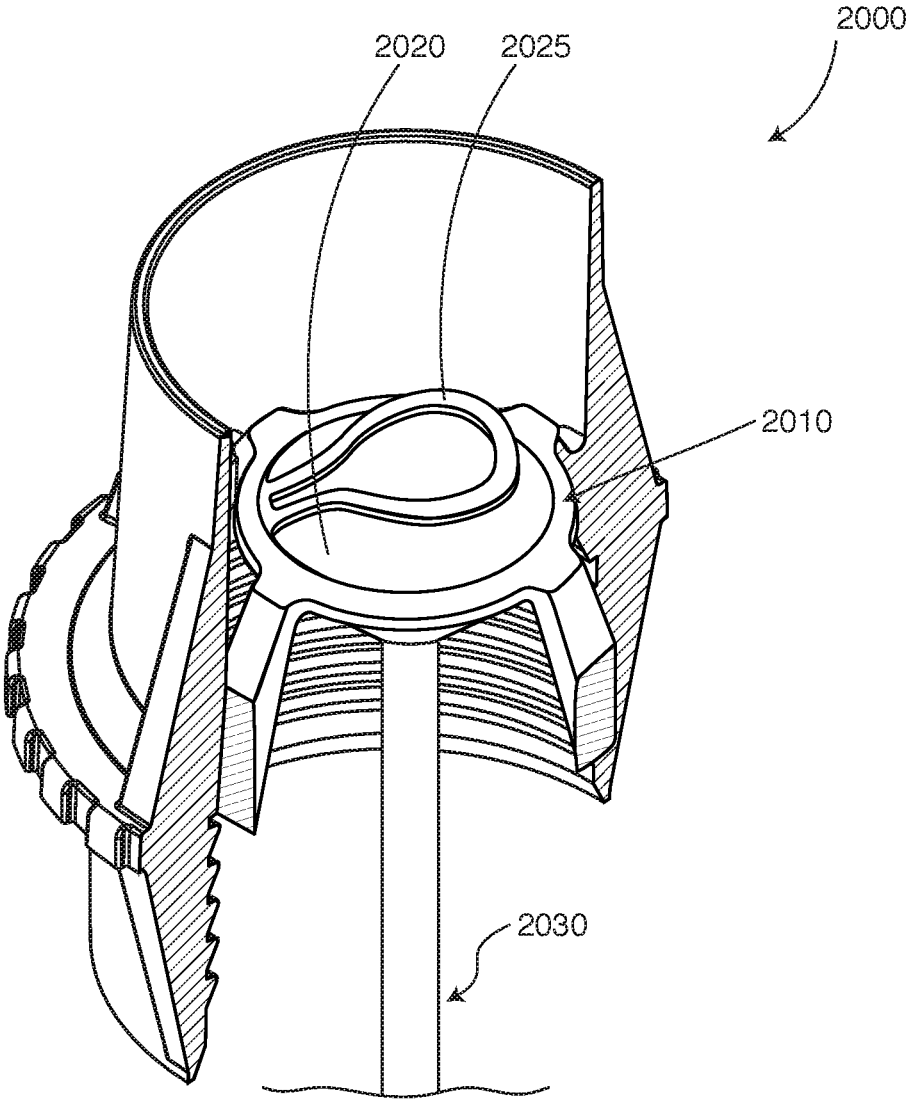
FIG. 20. Perspective cross-sectional view of certain embodiments of a closure component having a releasable seal.

Referring to FIG. 20, in certain embodiments of the invention, a closure component 2000 includes a releasable seal 2020. The releasable seal 2020 covers, for example, the upper portion of an inner cap 2010 of the closure component 2000, although it can be appreciated that the releasable seal covers other portions of the closure component. The releasable seal 2020 prevents the leaking of the contents of the container. The releasable seal 2020 is removable, for example, by peeling the seal from the closure component. It will be appreciated that the material of the releasable seal 2020 includes, for example, plastic, aluminum foil, paper, or other materials for sealing a container. In certain embodiments, the releasable seal 2020 is molded with the manufacturing of the closure component. In certain embodiments, a tab 2025 allows a user to remove the releasable seal 2020 by pulling on the tab 2025 to remove the releasable seal from the closure component 2000.

Figure 21:
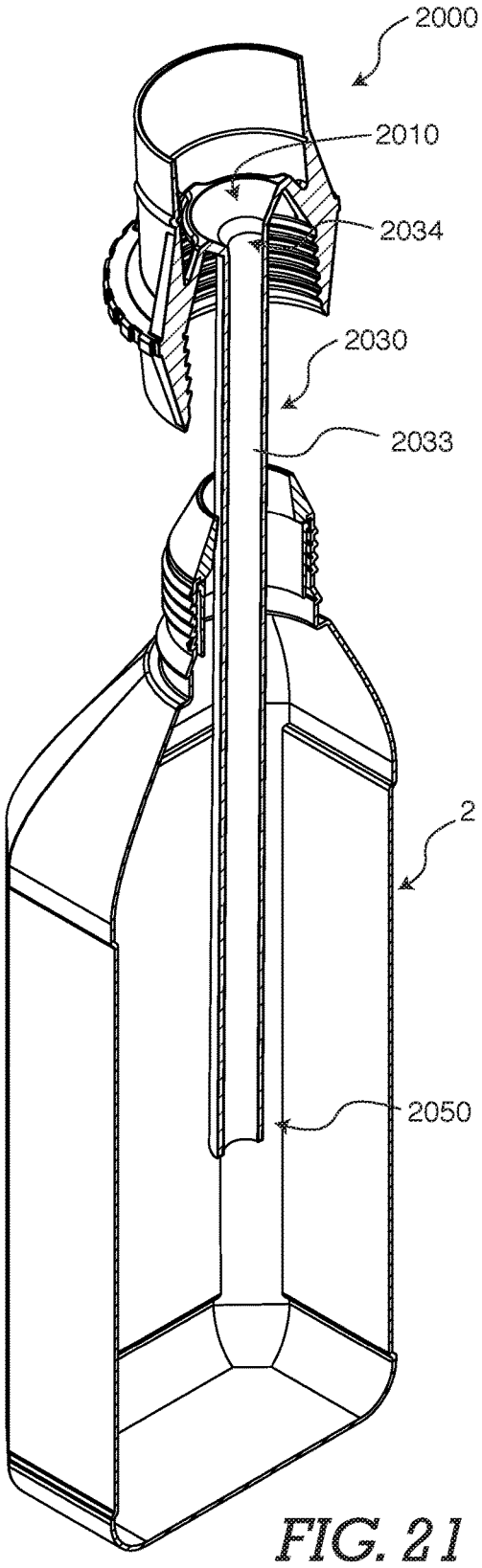
FIG. 21. Perspective cross-sectional view of certain embodiments of a closure component and a container.
Figure 22:
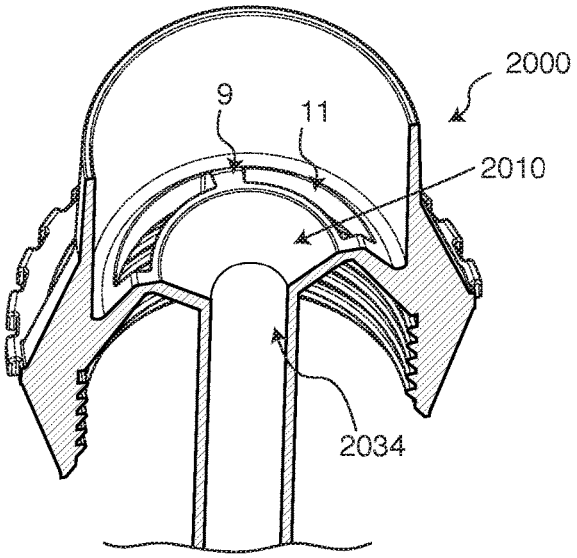
FIG. 22. Perspective cross-sectional view of certain embodiments of a closure component.
Figure 23:
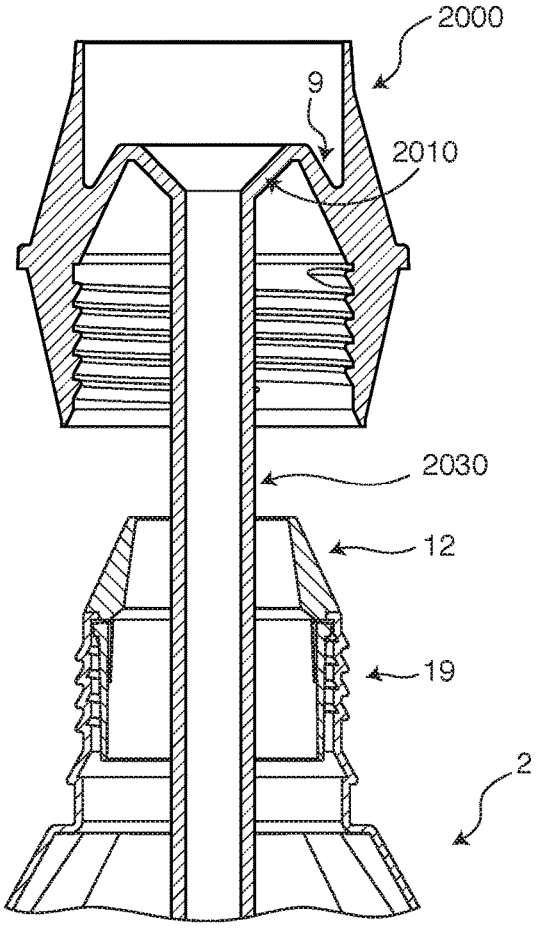
FIG. 23. Side cross-sectional view of view of certain embodiments of a closure component and a container.

Referring to FIGS. 21, 22, 23, 24A, and 24B, in certain embodiments of the invention, a closure component 2000 includes a tube 2030. Generally, the tube 2030 is attached to an inner aspect of the closure component 2000. The attachment between the tube 2030 and the closure component 2000 is achieved, for example, with a support such as rib 9 (as seen for example in FIG. 22). It will be appreciated that the attachment may comprise other support elements such as a disc. It will be appreciated that these support elements allow the suspension of a tube 2030 within an inner aspect of the closure component 2000, and that these support elements further comprise a lower surface. The lip 14 (as seen for example in FIG. 7C) of a container is configured to engage a lower surface when the closure component is in a closed configuration. Referring to FIGS. 21 and 22, the tube 2030 includes a first end 2034 disposed on a lower surface of the inner cap 2010 of the closure component 2000. In certain embodiments, a tube extends in a direction away from the convexity of the inner cap 2010. A tube 2030 includes a body having a passageway 2033 that extends from the first end 2034 towards the second end 2050 of the tube. It will be appreciated that in certain embodiments, the body of the tube is disposed within an inner cap, where the first end of the tube is disposed above the inner cap. Referring to FIGS. 22 and 23, one or more ribs 9 connect an inner cap 2010 to the body of the closure component 2000, forming one or more vents 11 in an area between an inner cap 10 and an inner aspect of the closure component 2000. Still referring to FIGS. 21 and 23, the tube 2030 extends into the container 2. Referring to FIG. 23, the closure component 2000 can be mated with, for example, a nozzle collar 12 attached to the neck 19 of a container. In certain embodiments of the invention, a closure component 2000 and tube 2030 are manufactured as a one-piece component, although it will be appreciated that in other embodiments, a tube 2030 may be a separate piece attachable to the inner cap 2010.

Figure 24A:
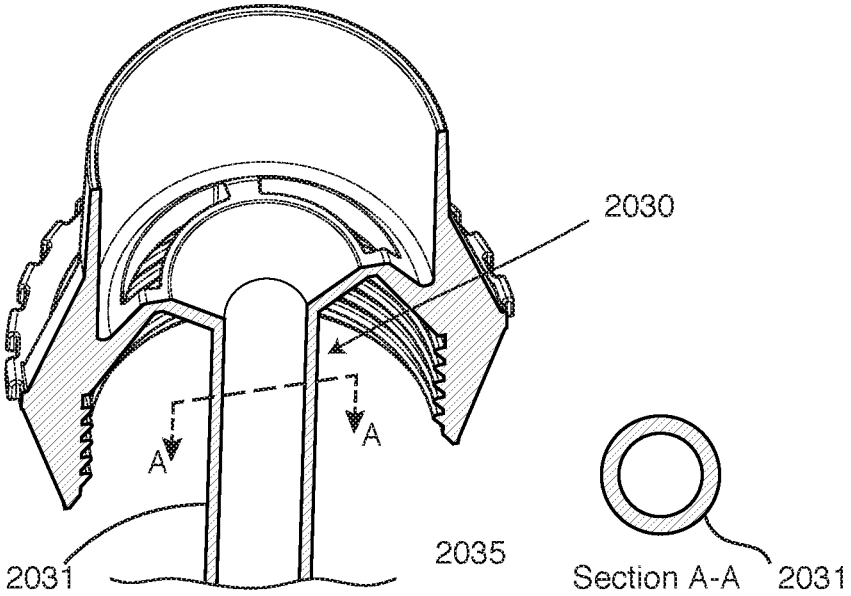
FIG. 24A. Perspective cross-sectional view of certain embodiments of a closure component with a further cross-sectional view of a tube.
Figure 24B:
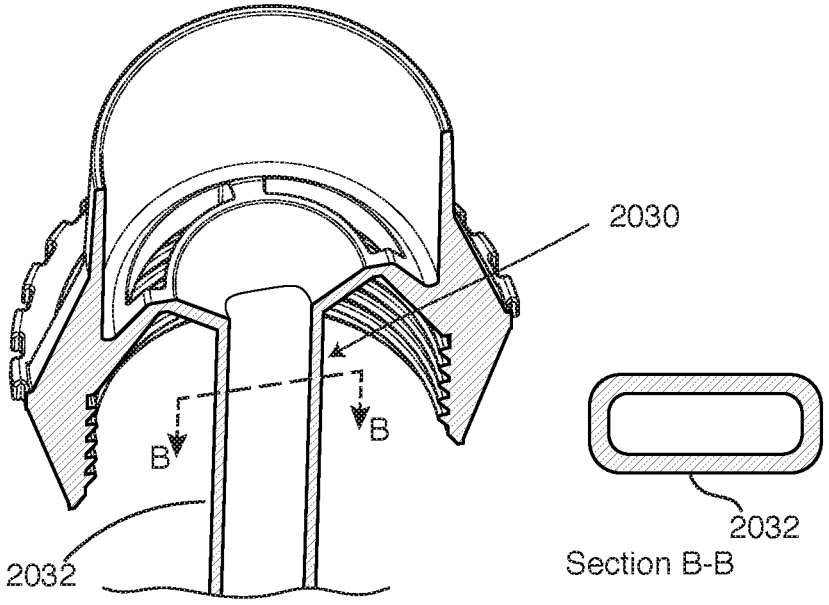
FIG. 24B. Perspective cross-sectional view of certain embodiments of a closure component with a further cross-sectional view of a tube.

Referring to FIG. 24A, in certain embodiments of the invention, as seen in a section A-A of the tube 2030, the tube comprises a circular form 2031. In certain embodiments of the invention, as shown in FIG. 24B, as seen section B-B of the tube 2030, the tube is provided in an oblong form 2032. It will be appreciated that the cross-section of a tube 2030 may comprise any shape while in keeping with the scope and spirit of the present application. Exemplary shapes of the cross-section include but are not limited to, for example, polygonal, rectangular, ovoid, and elliptical shapes.

Figure 25:
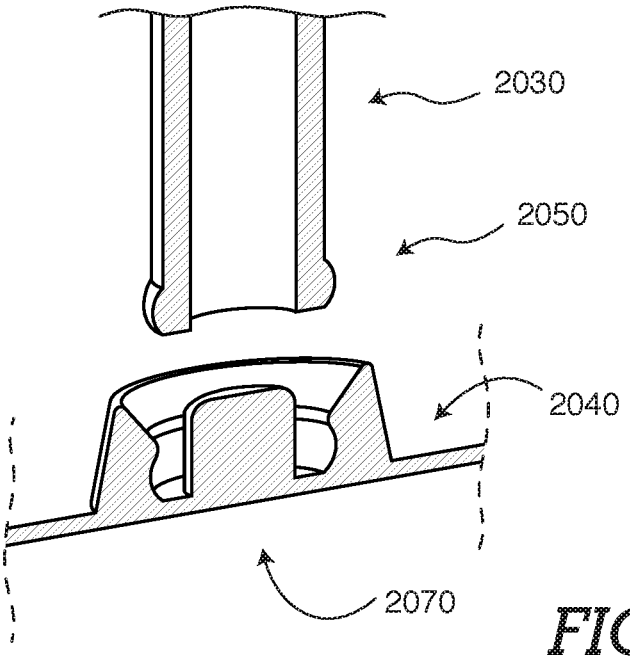
FIG. 25. Perspective cross-sectional view of certain embodiments of a container bottom and a closure component tube.

Referring to FIG. 25 showing a bottom portion of a container, in certain embodiments of the invention, a tube-end seal 2070 disposed on the container bottom surface 2040, is engageable with the second end 2050 of the tube. The tube-end seal 2070 blocks the bottom portion of the tube to prevent liquid from entering the tube. The tube-end seal 2070 comprises a form substantially similar to the form of the tube 2030 such as shown in FIG. 24A and FIG. 24B to allow the tube-end seal 2070 to mate with the second end 2050 of the tube.

Figure 26:
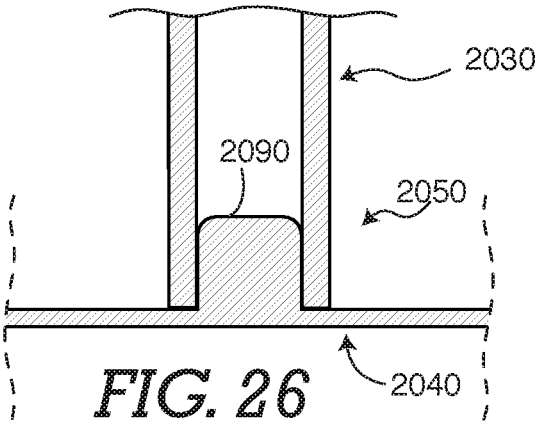
FIG. 26. Side cross-sectional view of view of certain embodiments of a closure component tube and a container bottom.
Figure 27:
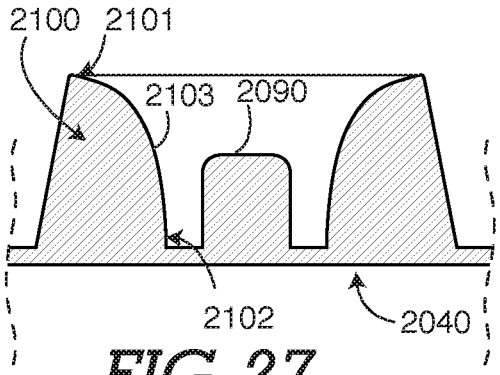
FIG. 27. Side cross-sectional view of view of certain embodiments of a container bottom.
Figure 28:
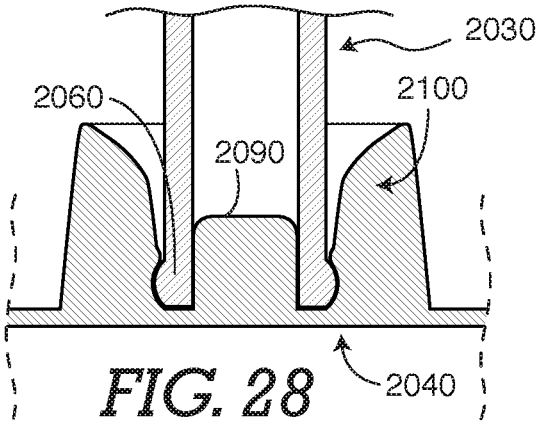
FIG. 28. Side cross-sectional view of view of certain embodiments of a closure component tube and a container bottom.

Referring to FIG. 26, in certain embodiments of the invention, a tube-end seal comprises a plug 2090 disposed on the bottom surface 2040 configured to block the second end 2050 of the tube. Referring to FIG. 27, in certain embodiments of the invention, a tube-end seal comprises a socket 2100 configured to receive the second end of the tube. In certain embodiments, for example, as shown in FIGS. 27 and 28, the socket 2100 allows for the alignment of the second end 2050 of the tube with a plug 2090 disposed within the socket. The socket 2100 may include, for example, a first inner diameter 2101 that is greater than second inner diameter 2102, forming a sloped surface 2103. The sloped surface 2103 is configured to guide the tube 2030 into a position wherein a plug 2090 can seal the end of the tube.

Figure 29:
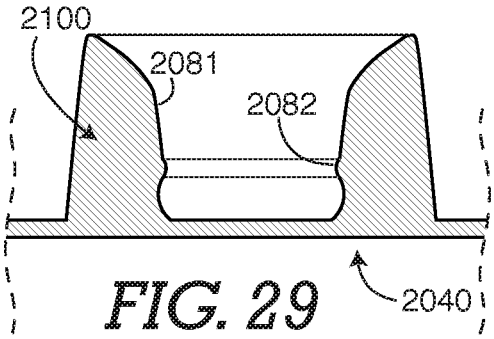
FIG. 29. Side cross-sectional view of view of certain embodiments of a container bottom.

Referring to FIG. 28, in certain embodiments of the invention, a container has a socket 2100 that allows the tube to be guided into place. Referring to FIG. 29, the socket has a surface 2081 with a slope. Referring to FIG. 28, the end of a tube 2030 further includes an annular feature 2060 configured to engage with socket 2100. In certain embodiments, the annular feature 2060 comprises a convex form, and in certain embodiments, the annular feature 2060 comprises a concave form. It will be appreciated that, in certain embodiments of the invention, an annular feature comprises a gasket, while certain embodiments include a material having gasket-like properties to augment a seal. It will be appreciated that materials having gasket-like properties include for example, but are not limited to, a rubber gasket, silicone gasket, physical grooves, or a ring made of any number of materials such as plastic, cork, rubber, felt, neoprene, nitrile rubber, PTFE, and plastic polymer. In certain embodiments a tube-end seal comprises a plug 2090 positioned in the socket 2100, as seen in FIGS. 28 and 29, wherein the tube-end seal further comprises an annular feature 2082 in the socket 2100. It will be appreciated that the annular feature 2082 of the socket comprises a concave form, and in certain embodiments, the annular feature 2060 comprises a concave form. The annular feature 2082 of the socket is configured to engage with the annular feature 2060 of the tube, thus creating a seal. It will be appreciated that in certain embodiments, a tube-end seal includes a plug, a socket, or both a plug and socket.

In certain embodiments of the invention, a second end of a tube comprises a detachable plug (not shown). The detachable plug of certain embodiments is initially disposed within the second end of the tube, the plug having a body that closes the passageway of the tube at the second end. In one example, this detachable plug includes an annular feature that engages with an annular feature 2082 located on a socket 2100, as seen in FIG. 29. The detachable plug is then retained by the annular feature 2082 when the tube is retracted from the annular feature. Accordingly, the detachable plug is removed from the second end of the tube, thereby transferring the detachable plug from the second end of the tube to the tube-end seal located at the bottom of the container bottom surface 2040.

Referring to FIGS. 25, 26, and 27, it will be appreciated that the tube-end seal 2070 engages with the second end 2050 of the tube when the closure component 2000 is in a closed configuration relative to the neck of the container. For instance, the closure component may be rotated in a first direction in relation to the tapered head 46 or a nozzle collar 12 of a container body 47, as seen in FIGS. 7B and 7C. Referencing FIG. 21, when the threads of the closure component 2000 are engaged with the thread of the tapered head 46 or nozzle collar 12 (seen for example in FIGS. 7B and 7C), the lower surface of the inner cap 2010 contacts the lip 14 (seen for example in FIG. 7C), resulting in the container having a closed configuration, and further resulting in the tube 2030 moving toward the tube-end seal 2070 to engage the tube-end seal 2070 (seen for example in FIG. 25). In such closed configuration, a seal forms between the tube-end seal 2070 and the second end 2050 of the tube. When the closure component 2000 is rotated in a second direction to open the container, the container is placed in an open configuration wherein the second end 2050 of the tube is withdrawn from the tube-end seal 2070. This open configuration breaks or disengages the seal between the tube-end seal 2070 and the second end 2050 of the tube. The tube introduces air-flow into the container when the container is inverted and the closure component is in open configuration, providing augmented flow of the liquid. It will be appreciated that the added air-flow results in a more consistent, more controllable, and more rapid dispensation of a fluid held within the container.

Figure 30:
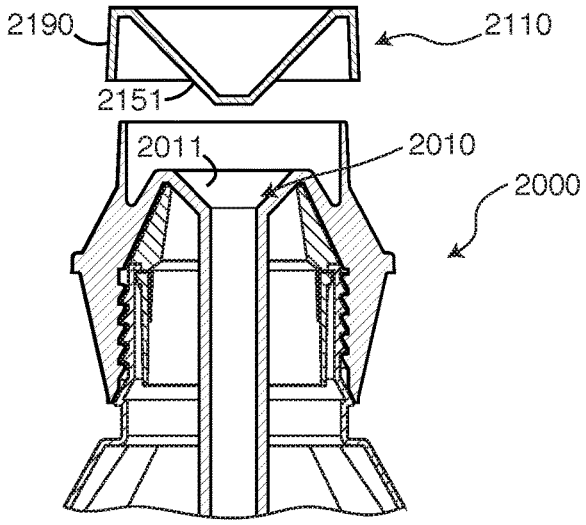
FIG. 30. Side cross-sectional view of view of certain embodiments of a closure component, container, and closure component cover.
Figure 31:
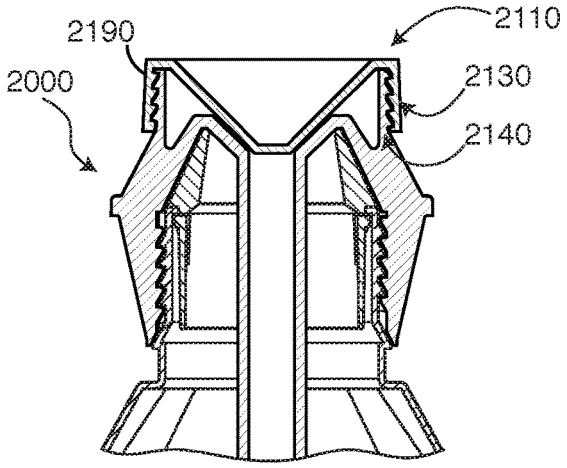
FIG. 31. Side cross-sectional view of view of certain embodiments of a closure component, container, and closure component cover.

In certain embodiments of the invention, a closure component includes a cover wherein the cover is configured to mate with the closure component. Referring to FIGS. 30 and 31, in certain embodiments, a cover 2110 includes a wall 2190 that has a shape that conforms to the shape of the closure component. Placement of the cover on the closure component seals the closure component. Referring to FIG. 30, in certain embodiments, a cover 2110 includes a surface 2151 that is substantially similar to the surface 2011 of the closure component inner cap 2010. For instance, in certain aspects, a closure component inner cap 2010 has a surface 2011 with a conical shape. The surface 2151 of the cover 2110 also has a conical shape that mates with the surface 2011 of the inner cap 2010 of the closure component 2000. It will be appreciated that the surface 2151 of the cover 2110 mates with the upper surface of the inner cap 2010 of the closure component 2000. In certain embodiments, the cover functions to close the tube 2030 located on the closure component 2000 inner cap 2010. In certain embodiments, the cover includes a stopper 2180 that plugs the tube 2030.

Referring to FIG. 31, in certain embodiments of the invention, a cover further includes threading 2130. A closure component 2000 also includes threading 2140 that engages with the threading 2130 of the cover 2110 to affix the cover 2110 to the closure component 2000.

Figure 32A:
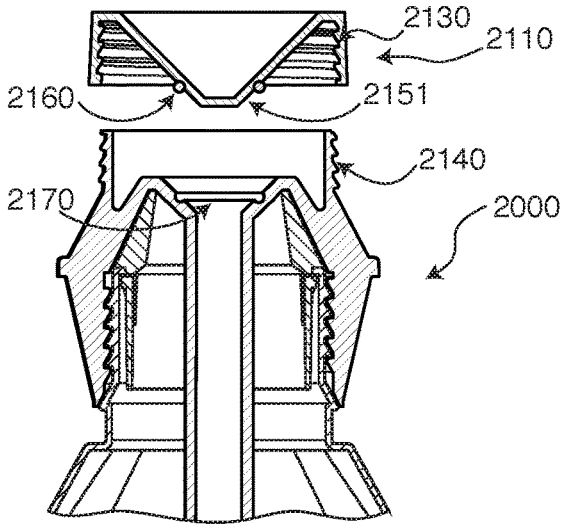
FIG. 32A. Side cross-sectional view of view of certain embodiments of a closure component, container, and closure component cover.
Figure 32B:
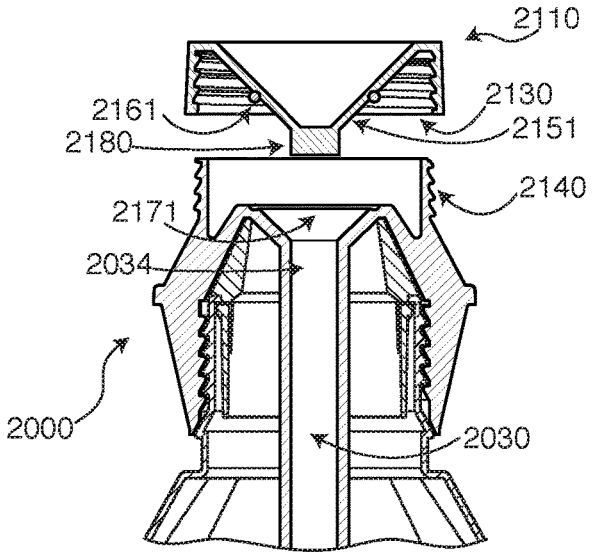
FIG. 32B. Side cross-sectional view of view of certain embodiments of a closure component, container, and closure component cover.

Referring to FIGS. 32A and 32B, in certain embodiments of the invention, the surface 2151 of the cover 2110 further includes an annular protruding element 2160, 2161. In certain embodiments, an annular protruding element includes, for example, a gasket. In certain embodiments of the invention, the closure component 2000 may also include an annular depression 2170, 2171 that accommodates the annular protruding element 2160, 2161. It will be appreciated that the location of the annular protruding element and annular depression may be located anywhere along the surfaces 2011, 2151.

Referring to FIG. 32B, in certain embodiments of the invention, the surface 2151 of the cover 2110 includes a stopper 2180 that extends into the tube 2030. The stopper 2180 forms a seal with the first end 2034 of the tube 2030.

The illustrations of arrangements described herein are intended to provide a general understanding of the structure of various embodiments, and they are not intended to serve as a complete description of all the elements and features of apparatus and systems that might make use of the structures described herein. Many other arrangements will be apparent to those of skill in the art upon reviewing the above description. Other arrangements may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. The descriptive labels associated with the numerical references in the figures are intended to merely illustrate embodiments of the invention, and are in no way intended to limit the invention to the scope of the descriptive labels. The present systems, methods, means, and enablement are not limited to the particular systems, and methodologies described, as there can be multiple possible embodiments, which are not expressly illustrated in the present disclosures. It is also to be understood that the terminology used in the description is for the purpose of describing the particular versions or embodiments only, and is not intended to limit the scope of the present application.

Some embodiments, illustrating its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise. Although any methods, and systems similar or equivalent to those described herein can be used in the practice or testing of embodiments, the preferred methods, and systems are now described. The disclosed embodiments are merely exemplary.

What is claimed is:

1. A closure component, comprising:

a body having a proximal end, a distal end, and an opening therebetween;

an inner cap disposed between the distal end and the proximal end of the body;

the inner cap having a lower surface having a diameter;

the inner cap further comprising a tube having a first end, second end, and a passageway therebetween, the tube first end connected to the inner cap and extending away from the lower surface;

a first rib and a second rib, each having connection to the inner cap and an inner aspect of the body;

a first vent and a second vent disposed between the ribs;

a tapered head comprising a proximal end with an opening therethrough; and the tapered head further comprising a lip having a diameter equal to or less than the diameter of the inner cap, wherein contact between the lip of the tapered head and the inner cap of the body forms a seal.

2. The closure component in claim 1, wherein the body further comprises threads on an internal aspect;

wherein the tapered head comprises outer threads configured to threadably engage with the threads of the body; and wherein the rotation of the body in a first direction in relation to the tapered head, with the threads of the body and tapered head engaged, until the lower surface of the inner cap contacts the lip, thereby results in a closed configuration, and wherein the rotation of the body in a second direction in relation to the tapered head until the lower surface of the inner cap no longer contacts the lip, thereby results in an open configuration.

3. The closure component of claim 1, further comprising a container connected to the tapered head, wherein the container is configured for retaining a liquid.

4. The closure component of claim 3, wherein the container comprises a tube-end seal on a bottom surface of the container, wherein the tube-end seal engages the second end of the tube when the body and tapered head are in a closed configuration, and wherein the tube-end seal disengages the second end of the tube when the body and tapered head are in an open configuration.

5. The closure component of claim 1, wherein the tube is detachable from the lower surface of the inner cap.

6. The closure component of claim 1, wherein an outer aspect of the body further comprises a plurality of fins and an annular handle.

7. The closure component of claim 1, wherein the tapered head further comprises a nozzle head and a collar body; and an overhang between the nozzle head and the collar body.

8. The closure component of claim 1, wherein the body further comprises an annular recess consistent with an internal surface of the body.

9. The closure component of claim 1, wherein the inner cap further comprises an annular groove configured to mate with the lip of the tapered head.

10. The closure component of claim 1, wherein the body further comprises venting grooves consistent with an external surface of the body.

11. The closure component of claim 1, wherein the body further comprises more than two ribs and more than two vents.

12. The closure component of claim 1, wherein the body further comprises a releasable seal covering an upper portion of the inner cap.

13. The closure component of claim 1, further comprising a cover, the cover having a wall that is the same shape as the proximal end of the body, and wherein the cover is attachable to the body.

14. The closure component of claim 13, wherein the cover further comprises threads, and a surface that is substantially similar to an upper surface of the inner cap;

wherein the body further comprises threads on an external aspect; and wherein the body and the cover, when threadably engaged and the cover is rotated in a first direction relative to the body, the resulting mating of the cover with the inner cap results in sealing the tube first end.

15. The closure component of claim 1, wherein the cross section of the tube is an oblong shape.

16. A fluid dispensing assembly, comprising:

a container having an opening at a neck of the container;

a closure component for the container comprising a distal end affixed to the neck of the container;

the closure component further comprising an opening extending from the distal end of the closure component to a proximal end of the closure component;

a tube having a first end, the tube affixed to an inner aspect of the closure component, and a second end of the tube disposed within the container;

a tube-end seal affixed within the container, wherein the tube-end seal is the same shape as the tube; and the tube-end seal configured to engage with the second end of the tube, wherein the tube-end seal engages with and seals the second end of the tube when the closure component is in a closed configuration, and wherein the tube-end seal is disengaged from the second end of the tube when the closure component is in an open configuration.

17. The fluid dispensing assembly of claim 16, wherein the attachment of the tube to the inner aspect of the closure defines a lower surface; and the container opening comprises a lip;

wherein the lip is configured to engage the lower surface when the closure component is in a closed configuration.

18. The fluid dispensing assembly of claim 16, further comprising a first rib and a second rib, wherein each rib is connected to the tube and the inner aspect of the closure component, thereby affixing the tube to the inner aspect of the closure component.

19. The fluid dispensing assembly of claim 17, wherein the closure component further comprises threads on an internal aspect; and the container opening comprises threads on an outer aspect configured to threadably engage with the threads of the closure component, wherein the rotation of the closure component in a first direction with the threads of the closure component and the container engaged, thereby moving the lower surface of the closure component in a first direction until it contacts the lip, results in a closed configuration, and wherein the rotation of the closure component in a second direction with the threads of the closure component and the container engaged, thereby moving the lower surface of the closure component in a second direction until the lower surface of the closure no longer contacts the lip, results in an open configuration.

20. The fluid dispensing assembly of claim 16, further comprising a cover comprising a wall, the wall having a shape that is similar to the closure component;

wherein the cover is attachable to the proximal end of the closure component thereby closing the closure component.

* * * * *